US012398962B2

(12) United States Patent
Sakai et al.

(10) Patent No.: US 12,398,962 B2
(45) Date of Patent: Aug. 26, 2025

(54) HEAT EXCHANGE UNIT

(71) Applicant: Mitsubishi Electric Corporation, Tokyo (JP)

(72) Inventors: Mizuo Sakai, Tokyo (JP); Koji Noguchi, Tokyo (JP); Yusuke Takahashi, Tokyo (JP); Nobukazu Kato, Tokyo (JP); Shoko Tsumura, Tokyo (JP); Hirokazu Murakami, Tokyo (JP); Motoki Otsuka, Tokyo (JP); Yudai Sakabe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 62 days.

(21) Appl. No.: 18/553,912

(22) PCT Filed: Aug. 2, 2021

(86) PCT No.: PCT/JP2021/028552

§ 371 (c)(1),
(2) Date: Oct. 4, 2023

(87) PCT Pub. No.: WO2023/012850

PCT Pub. Date: Feb. 9, 2023

(65) Prior Publication Data

US 2024/0183625 A1 Jun. 6, 2024

(51) Int. Cl.

| | |
|---|---|
| ***F28F 9/007*** | (2006.01) |
| ***F24F 1/56*** | (2011.01) |
| ***F28D 21/00*** | (2006.01) |

(52) U.S. Cl.

CPC ..... *F28F 9/007* (2013.01); *F24F 1/56* (2013.01); *F28D 21/00* (2013.01); *F28D 2021/0068* (2013.01)

(58) Field of Classification Search

CPC .. F28F 9/007; F24F 1/56; F28D 21/00; F28D 2021/0068

(Continued)

(56) References Cited

FOREIGN PATENT DOCUMENTS

CN 108758871 A * 11/2018 ..... E05B 65/00
CN 210463236 U * 5/2020

(Continued)

OTHER PUBLICATIONS

International Search Report of the International Searching Authority mailed Sep. 28, 2021 for the corresponding International Application No. PCT/JP2021/028552 (and English translation).

*Primary Examiner* — Devon Lane
(74) *Attorney, Agent, or Firm* — Posz Law Group, PLC

(57) ABSTRACT

An aspect of a heat exchange unit of a refrigeration cycle device, includes a housing having openings, and gripping members attached to the openings. Each gripping member has a main body having an inner space that opens to an outside, and a plurality of claws that protrude from the main body and that hook to a circumferential edge of the openings. The plurality of claws include a plurality of first claw portions, and at least one second claw portion that is provided on an opposite side to the plurality of first claw portions in a predetermined direction that intersects the opening direction. At least one claw portion out of the plurality of first claw portions and the at least one second claw portion is an elastic claw that is cantilevered by the main body and is elastically deformable in the predetermined direction with respect to the main body.

10 Claims, 15 Drawing Sheets

(58) Field of Classification Search
USPC ..... 165/165
See application file for complete search history.

(56) References Cited

FOREIGN PATENT DOCUMENTS

| | | | | | |
|---|---|---|---|---|---|
| CN | 116358055 | A | * | 6/2023 | |
| DE | 202012104804 | U1 | * | 3/2013 | ..... E05B 1/0046 |
| JP | H04-359722 | A | | 12/1992 | |
| JP | H06-022830 | U | | 3/1994 | |
| JP | 2013-217566 | A | | 10/2013 | |
| JP | 2022170396 | A | * | 11/2022 | |
| KR | 20210150823 | A | * | 6/2020 | |

* cited by examiner

HEAT EXCHANGE UNIT

CROSS REFERENCE TO RELATED APPLICATION

This application is a U.S. national stage application of International Application No. PCT/JP2021/028552, filed on Aug. 2, 2021, the contents of which are incorporated herein by reference.

TECHNICAL FIELD

The present disclosure relates to a heat exchange unit.

BACKGROUND

For example, a grip that is attached to a cabinet of an outdoor unit of an air conditioner that is used during transport or the like is described in Patent Document 1. A method of attaching the grip in Patent Document 1 is done by pressing and fixing grips to side plates of the cabinet by providing open recesses, into which the grips are fit, on a front surface plate and a rear surface plate of the cabinet.

PATENT DOCUMENT

Patent Document 1: Japanese Unexamined Patent Application, First Publication No. H04-359722

In a case similar to the case of the method of attaching a grip as mentioned above, there is a need to sandwich the grip between differing plate members of the cabinet, and the work efficiency of attaching the grip is bad. On the other hand, if openings are provided in the cabinet, and a method of inserting the grip into the openings is adopted, the work efficiency of attaching the grip improves. In such a case however, a problem of the attachment strength of the grips easily declining exists.

SUMMARY

The present disclosure has been made in order to address the problem above, and an object is to provide a heat exchange unit that has a construction where it is possible to ensure an attachment strength of gripping members, while improving a work efficiency of attaching the gripping members.

An embodiment of a heat exchange unit according to the present disclosure is a heat exchange unit of a refrigeration cycle device that includes a housing having openings, and gripping members attached to the openings. Each gripping member of the gripping members has a main body having an inner space that opens to an outside of the housing, and a plurality of claws that protrude from the main body, and that hook to a circumferential edge of the openings from an inside of the housing. The plurality of claws include a plurality of first claw portions, and at least one second claw portion that is provided on an opposite side to the plurality of first claw portions in a predetermined direction that intersects the opening direction of an opening. At least one claw portion out of the plurality of first claw portions and the at least one second claw portion is an elastic claw that is cantilevered by the main body, and the elastic claw is elastically deformable in the predetermined direction with respect to the main body. The plurality of first claw portions include at least one fixed claw, and at least one elastic claw, and the protrusion height of the at least one fixed claw with respect to the main body is less than the protrusion height of the at least one elastic claw with respect to the main body.

According to the present disclosure, it is possible to ensure an attachment strength of the gripping members, while improving a work efficiency of attaching the gripping members.

DETAILED DESCRIPTION

Figure 1:
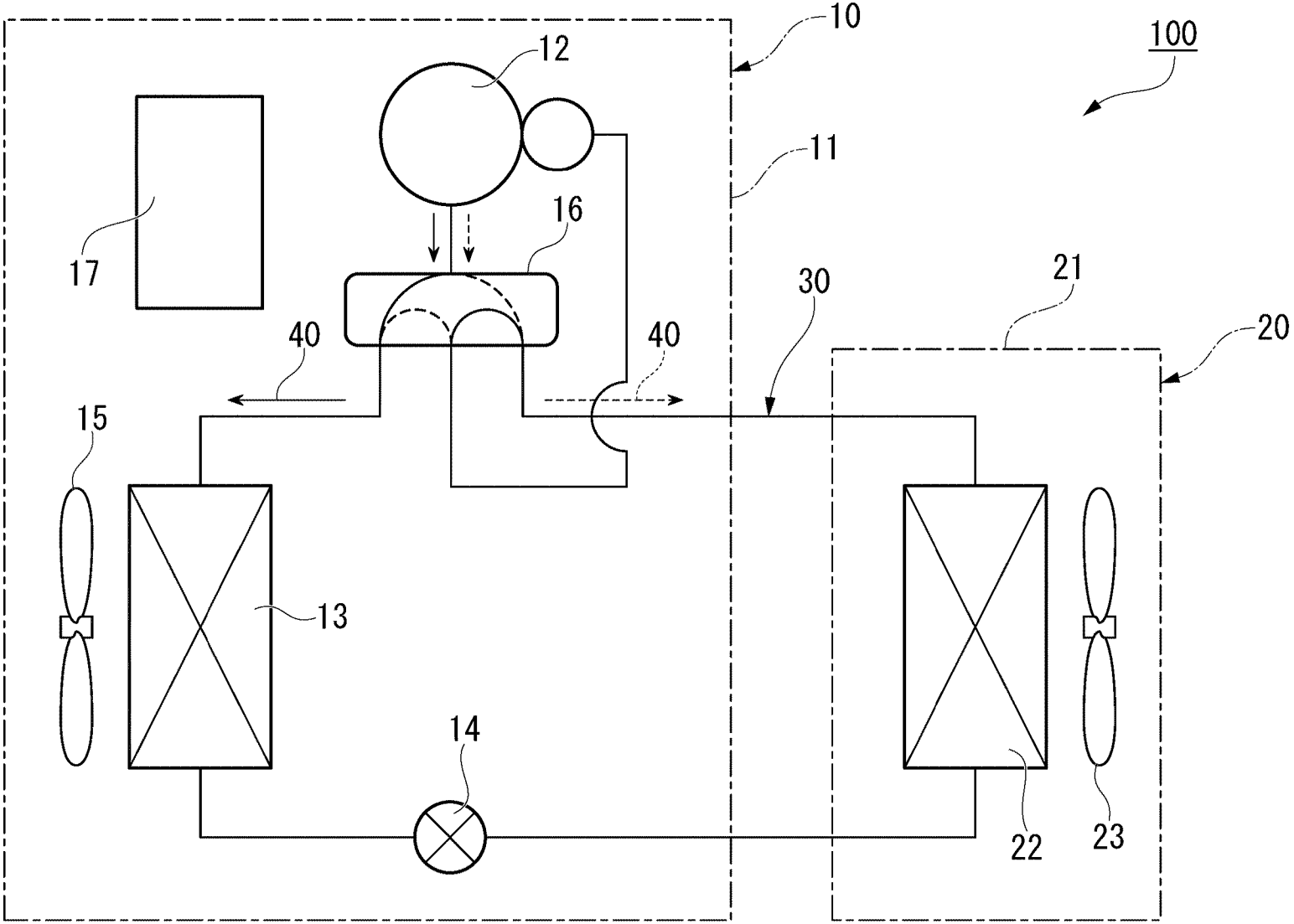
FIG. 1 A schematic block diagram that schematically shows a refrigeration cycle device that is included in an outdoor unit in a first embodiment.

Hereinafter, an embodiment is explained with reference to drawings. The scope of the present disclosure is not limited to the embodiments below, and may be changed appropriately so long as the changes are within the scope of the technical idea of the present disclosure. In order to facilitate better understanding of the various configurations, there are cases where scales and numbers or the like of various configurations in the drawings below differ from scales and numbers of actual configurations.

An X axis, a Y axis, and a Z axis are shown in the drawings as deemed appropriately. The X axis shows a front-back direction of an outdoor unit 10 in the embodiments below. The Y axis shows a width direction of the outdoor unit that is orthogonal to the front-back direction. The Z axis shows a vertical direction. The front-back direction, the width direction, and the vertical direction are directions that mutually cross one another. Hereinafter, the front-back direction is referred to as a "front-back direction X", the width direction is referred to as a "width direction Y", and the vertical direction is referred to as a "vertical direction Z". The vertical direction, or a Z axis direction corresponds to a "predetermined direction".

Out of sides of the front-back direction X, a side to which an arrow of the X axis faces (+X side) is a front side of the outdoor unit. Out of the sides of the front-back direction X, an opposite side to which the arrow of the X axis faces (−X side) is a back side of the outdoor unit. The width direction Y is a left-right direction of the outdoor unit. Out of the sides of the width direction Y, a side to which the arrow of the Y axis faces (+Y side) is a left side of the outdoor unit. Out of the sides of the width direction Y, an opposite side to which the arrow of the Y axis faces (−Y side) is a right side of the outdoor unit. In the description below, the side out of the sides of the width direction Y to which the arrow of the Y axis faces (+Y side), in other words the left side, is referred to as a "one side of the width direction". The opposite side out of the sides of the width direction Y to which the arrow of the Y axis faces (−Y side) is referred to as an "other side of the width direction". A side out of the sides of the vertical direction Z to which the arrow of the Z axis faces (+Z side) is a top side. An opposite side out of the sides of the vertical direction Z to which the arrow of the Z axis faces (−Z side) is a bottom side.

First Embodiment

FIG. 1 is a schematic block diagram that schematically shows a refrigeration cycle device 100 which is included in the outdoor unit 10 in a first embodiment. The refrigeration cycle device 100 is a device which utilizes a refrigeration cycle that circulates a refrigerant 40. The refrigeration cycle device 100 in the first embodiment is an air conditioning device. As shown in FIG. 1, the refrigeration cycle device 100 includes the outdoor unit 10, an indoor unit 20, and a circulation path 30. The outdoor unit 10 is disposed outdoors. The indoor unit 20 is disposed indoors. The outdoor unit 10 and the indoor unit 20 are mutually connected by the circulation path 30 that circulates the refrigerant 40. The outdoor unit 10 and the indoor unit 20 make up a heat exchange unit that conducts heat exchange between the units thereof and the surrounding atmosphere.

By the refrigeration cycle device 100 conducting heat exchange between the refrigerant 40 circulating inside the circulation path 30 and the indoor atmosphere where the indoor unit 20 is disposed, the temperature of the indoor atmosphere is adjustable. A refrigerant such as a fluorine based refrigerant with a low global warming potential (GWP: Global Warming Potential), or a hydrocarbon based refrigerant or the like may be mentioned as examples of the refrigerant 40.

The outdoor unit 10 has a housing 11, a compressor 12, a heat exchange device 13, a flow adjustment valve 14, a blower 15, a four-way valve 16, and a controller 17. The compressor 12, the heat exchange device 13, the flow adjustment valve 14, the blower 15, the four-way valve 16, and the controller 17 are housed on an inside of housing 11. The controller 17 controls the various parts of the outdoor unit 10. The controller 17 for example, may be a system controller that regulates the control of the entirety of the refrigeration cycle device 100.

Out of components on the circulation path 30, the compressor 12, the heat exchange device 13, the flow adjustment valve 14, and the four-way valve 16 are provided on a part located on the inside of housing 11. Out of the components on the circulation path 30, the compressor 12, the heat exchange device 13, the flow adjustment valve 14, and the four-way valve 16 are connected by the part located on the inside of housing 11.

The four-way valve 16 is provided on a portion connected to a discharge side of the compressor 12 out of components on the circulation path 30. The four-way valve 16 is able to reverse the flow of the refrigerant 40 inside the circulation path 30 by switching over a portion of the path of the circulation path 30. When the path connected by the four-way valve 16 is the path of the four-way valve 16 that is shown by solid lines in FIG. 1, the refrigerant 40 flows in the direction of the circulation path 30 shown by the solid line arrow in FIG. 1. On the other hand, when the path connected by the four-way valve 16 is the path of the four-way valve 16 that is shown by dashed lines in FIG. 1, the refrigerant 40 flows in the direction of the circulation path 30 shown by the dashed line arrow in FIG. 1.

The indoor unit 20 has a housing 21, a heat exchange device 22, and a blower 23. The heat exchange device 22 and the blower 23 are housed on an inside of housing 21. The indoor unit 20 is able to cool the indoor atmosphere the indoor unit 20 is disposed in, through a cooling operation. The indoor unit 20 is able to warm the indoor atmosphere the indoor unit 20 is disposed in, through a heating operation.

When the indoor unit 20 is in the cooling operation, the refrigerant 40 that flows within the circulation path 30 flows in the direction of the solid line arrow shown in FIG. 1. In other words, when the indoor unit 20 is in cooling operation, the refrigerant 40 that flows within the circulation path 30 circulates so as to return to the compressor 12 after passing through the compressor 12, the heat exchange device 13 of the outdoor unit 10, the flow adjustment valve 14, and the heat exchange device 22 of the indoor unit 20 in such an order. During the cooling operation, the heat exchange device 13 inside the outdoor unit 10 functions as a condenser, and the heat exchange device 22 of the indoor unit 20 functions as an evaporator.

On the other hand, when the indoor unit 20 is in the heating operation, the refrigerant 40 that flows within the circulation path 30 flows in the direction of the dashed line arrow shown in FIG. 1. In other words, when the indoor unit 20 is in heating operation, the refrigerant 40 that flows within the circulation path 30 circulates so as to return to the compressor 12 after passing through the compressor 12, the heat exchange device 22 of the indoor unit 20, the flow adjustment valve 14, and the heat exchange device 13 of the outdoor unit 10 in such an order. During the heating operation, the heat exchange device 13 inside the outdoor unit 10 functions as an evaporator, and the heat exchange device 22 of the indoor unit 20 functions as a condenser.

Figure 2:
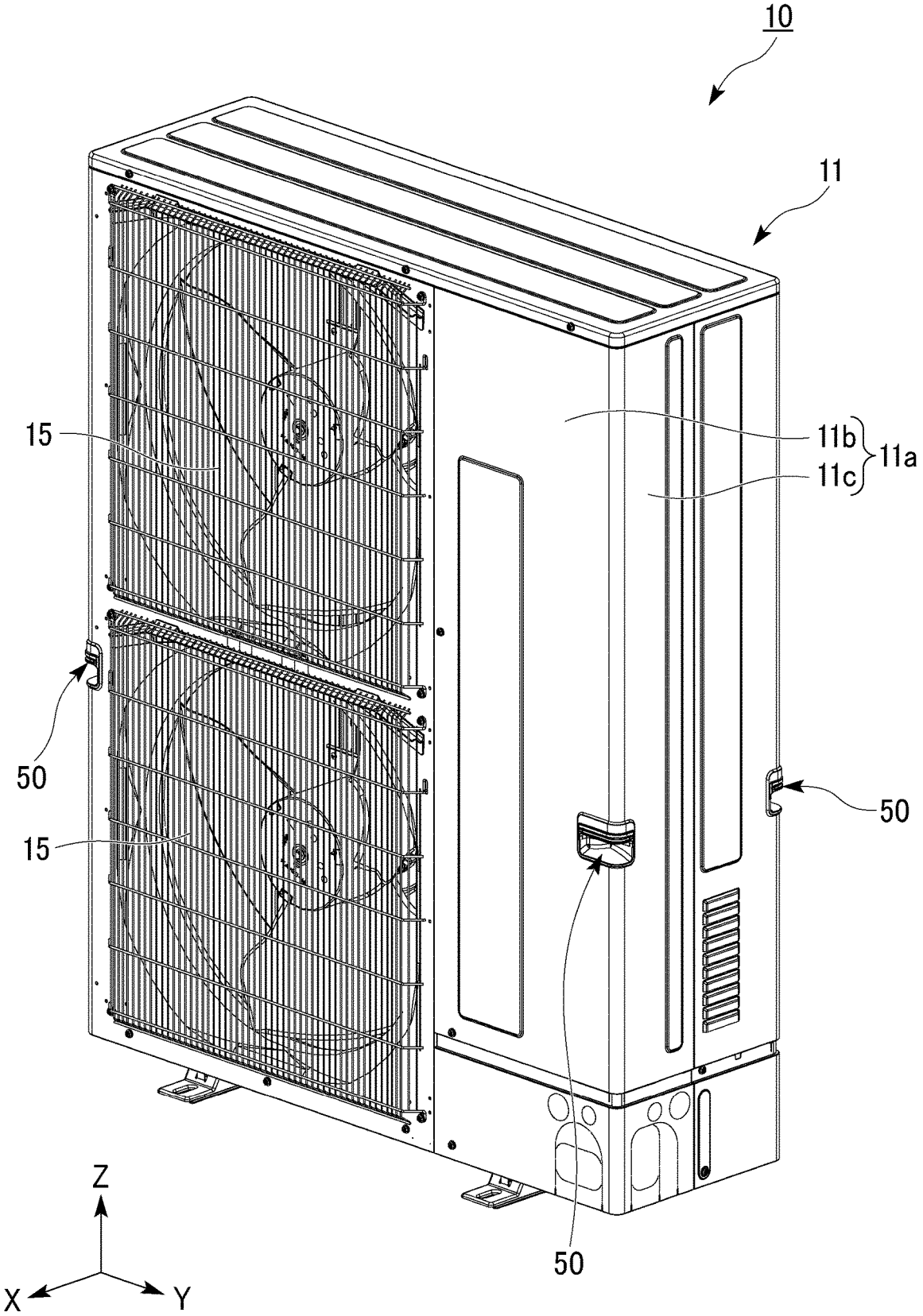
FIG. 2 A perspective view that shows the outdoor unit in the first embodiment.

Next, the outdoor unit 10 in the first embodiment is further explained. FIG. 2 is a perspective view that shows the outdoor unit 10. As shown in FIG. 2, the housing 11 is roughly a rectangular box-shape having surfaces that face each of the front-back direction X, the width direction Y, and the vertical direction Z. In the first embodiment, the housing 11 has two blowers 15 that are provided so as to be aligned in the vertical direction Z. The housing 11 has a front surface panel 11*a* that is attached so as to be detachable. The front surface panel 11*a* is a sheet metal member. The front surface panel 11*a* has a front wall portion 11*b* that configures a portion of a front side (+X side) wall portion in the housing 11, and a side wall portion 11*c* that configures a portion of the one side of the width direction (+Y side) wall portion in the housing 11. The side wall portion 11*c* bends to the back side (−X side), from the one side of the width direction of the front wall portion 11*b*.

The outdoor unit 10 includes gripping members 50. The gripping members 50 are members to which an operator or the like may hook their hands or fingers to when transporting the outdoor unit 10. The gripping members 50 in the first embodiment are resin members that are integrally formed by a metal mold of injection molding or the like. The resin that the gripping members 50 are configured from may for example be polypropylene or the like. A plurality of the gripping members 50 are provided. The gripping members 50 in the first embodiment are provided on each of four corner portions out of portions of the housing 11 to which the front-back direction X wall portion and the width direction Y wall portion are connected to. The gripping members 50 in the first embodiment are located on the bottom side in the vertical direction Z more than a center of the outdoor unit 10.

Figure 3:
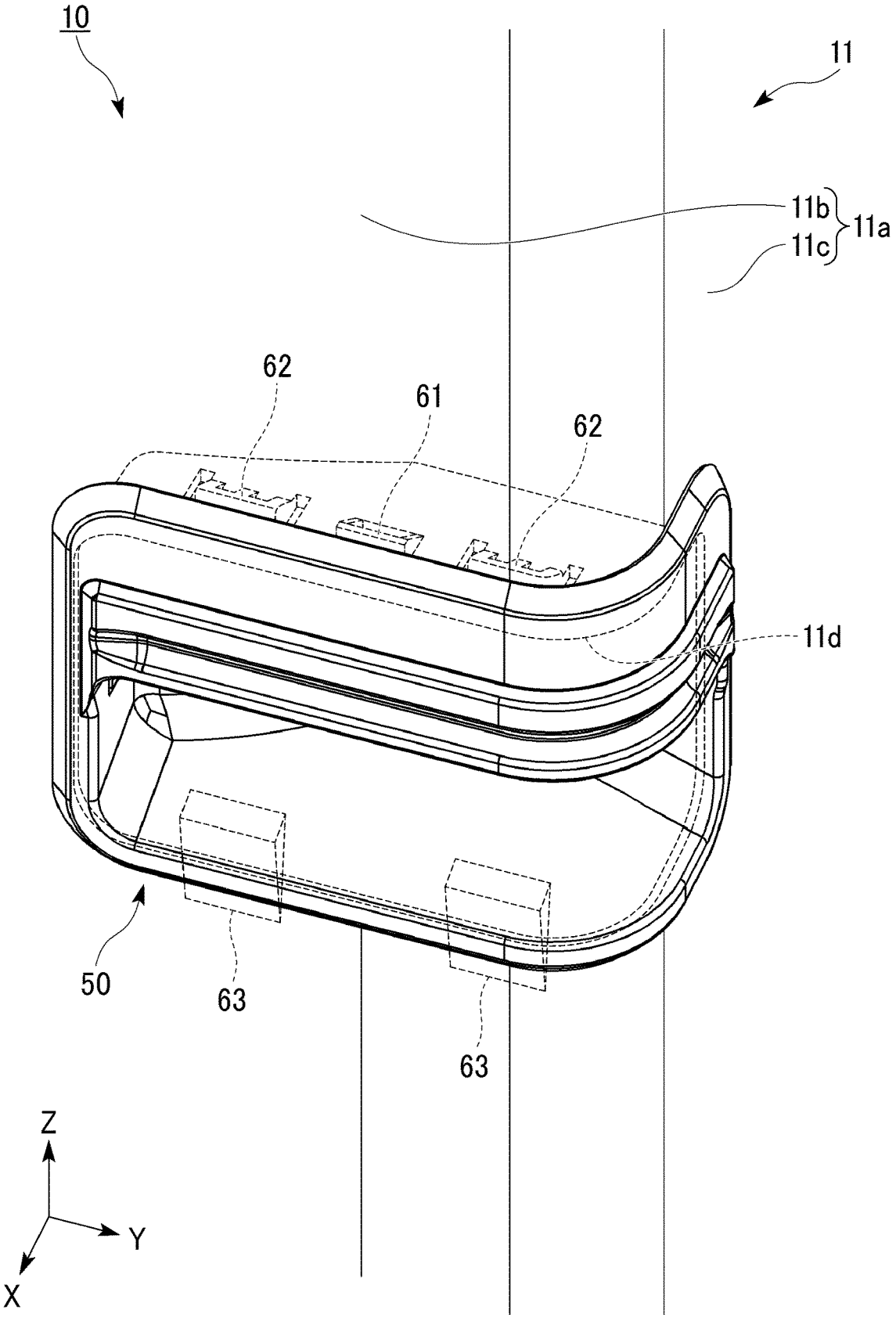
FIG. 3 A perspective view that shows a part out of parts of the outdoor unit in the first embodiment where a gripping member is attached.
Figure 4:
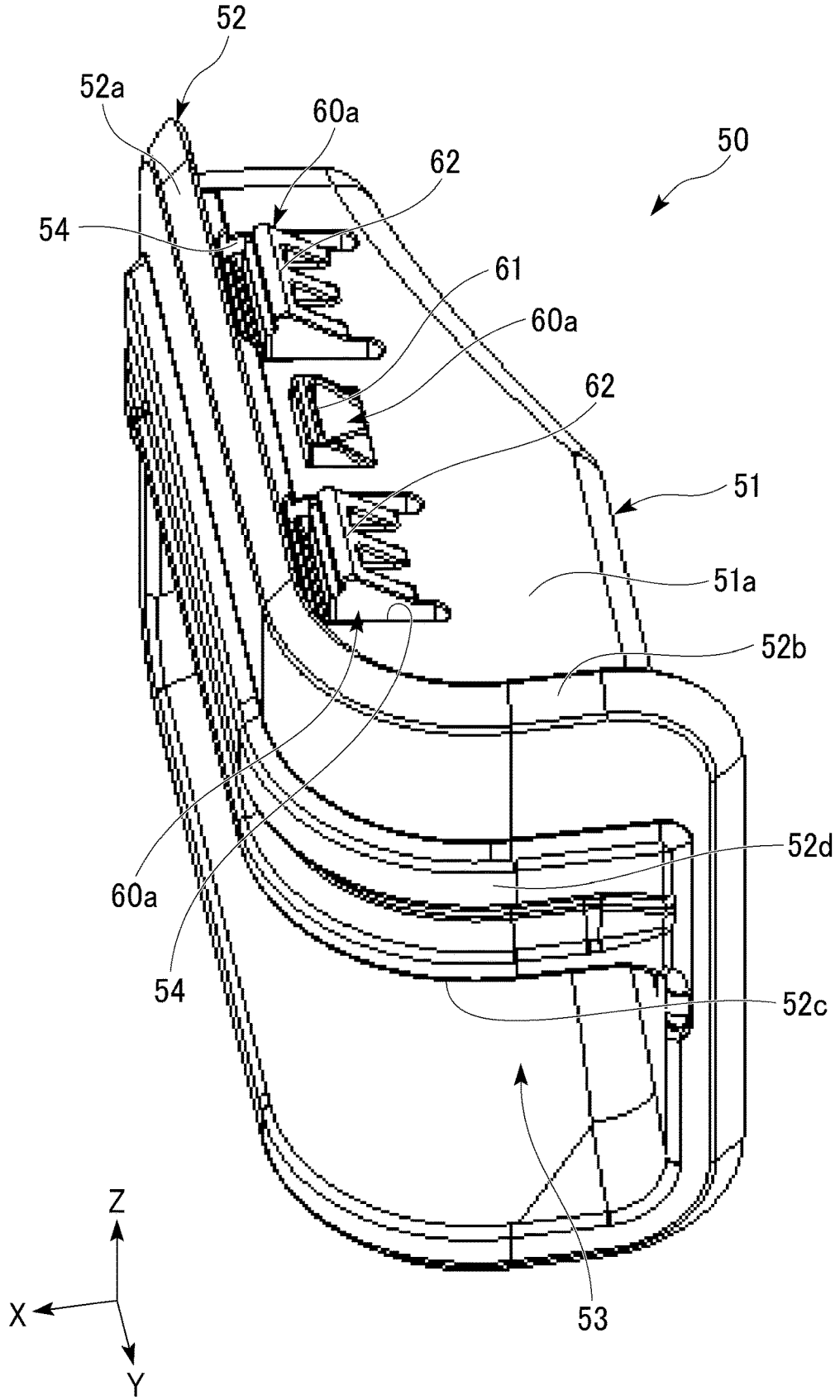
FIG. 4 A perspective view that shows the gripping member in the first embodiment.
Figure 5:
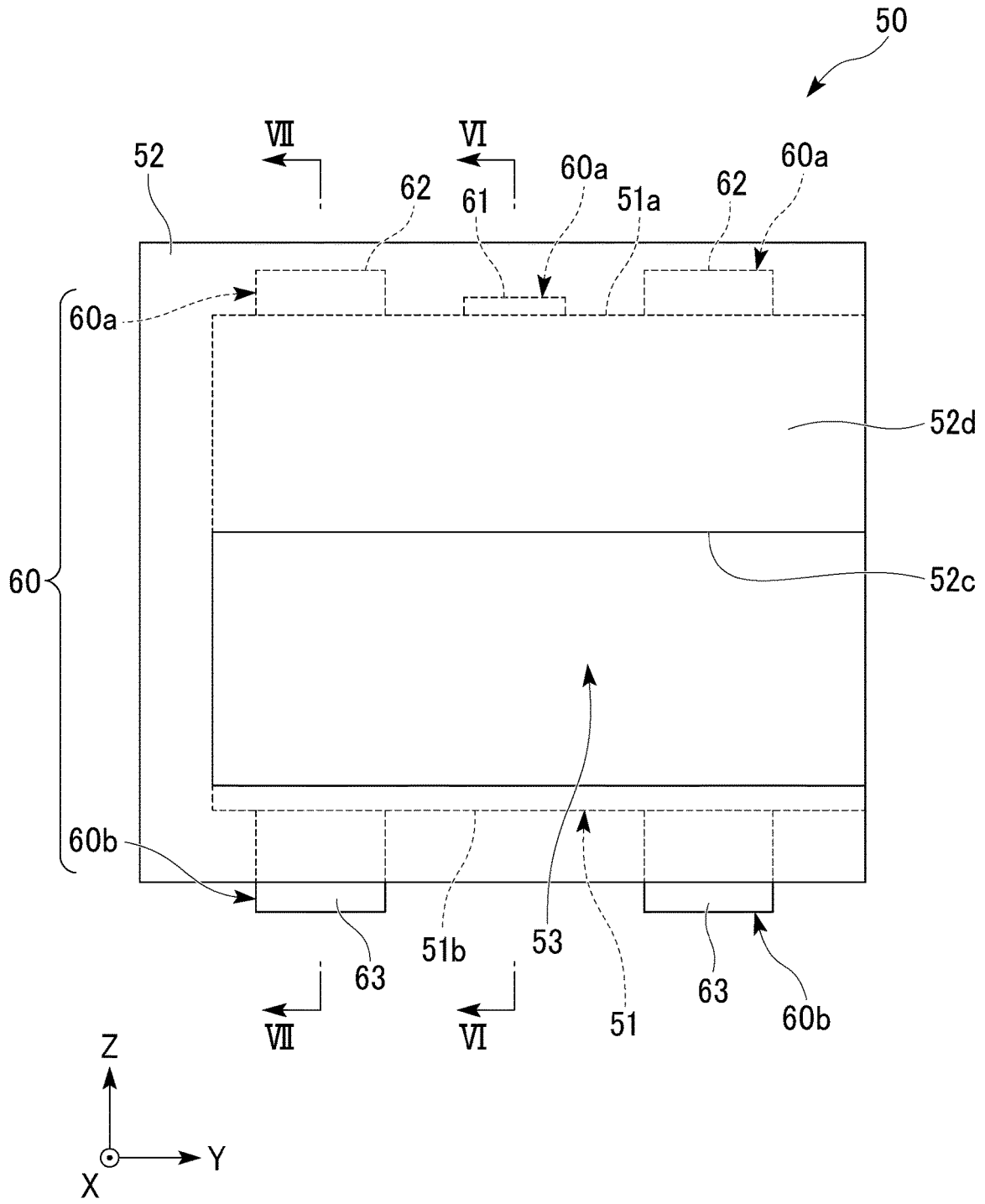
FIG. 5 A view of the gripping member in the first embodiment as seen from the front side.
Figure 6:
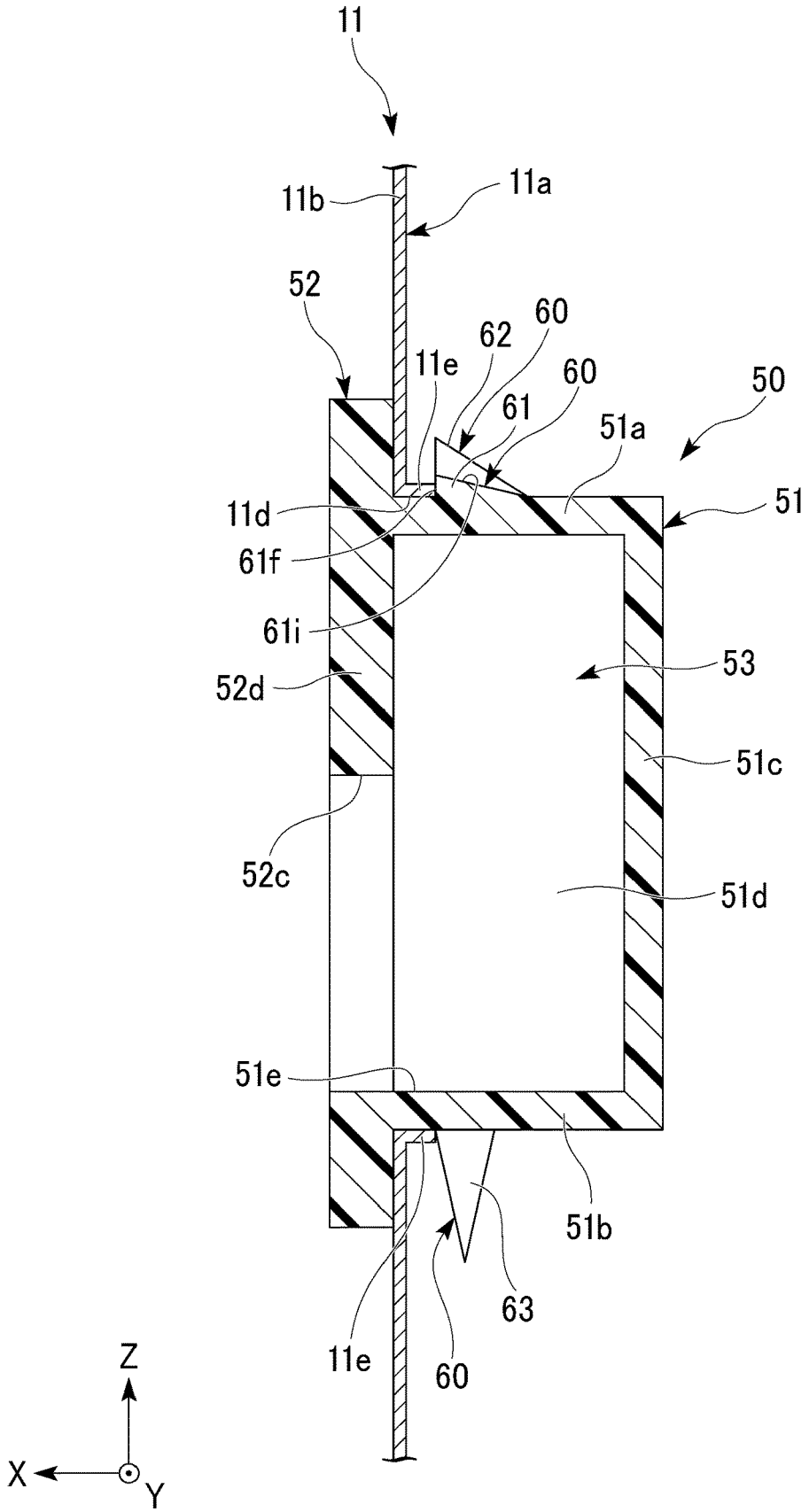
FIG. 6 A cross-sectional view that shows the gripping member in the first embodiment, and corresponds to the cross-sectional line VI-VI in FIG. 5.
Figure 7:
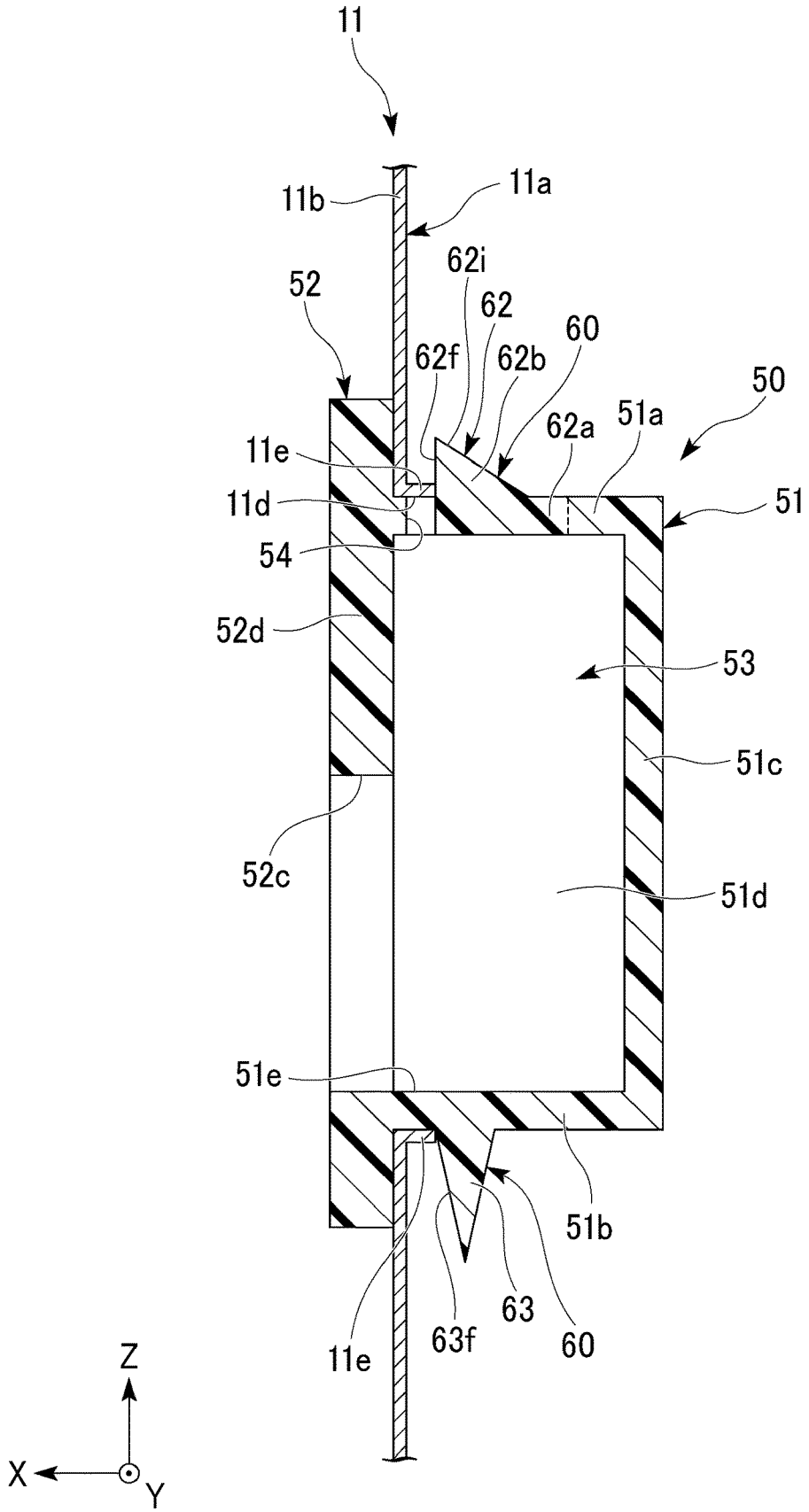
FIG. 7 A cross-sectional view that shows the gripping member in the first embodiment, and corresponds to the cross-sectional line VII-VII in FIG. 5.
Figure 8:
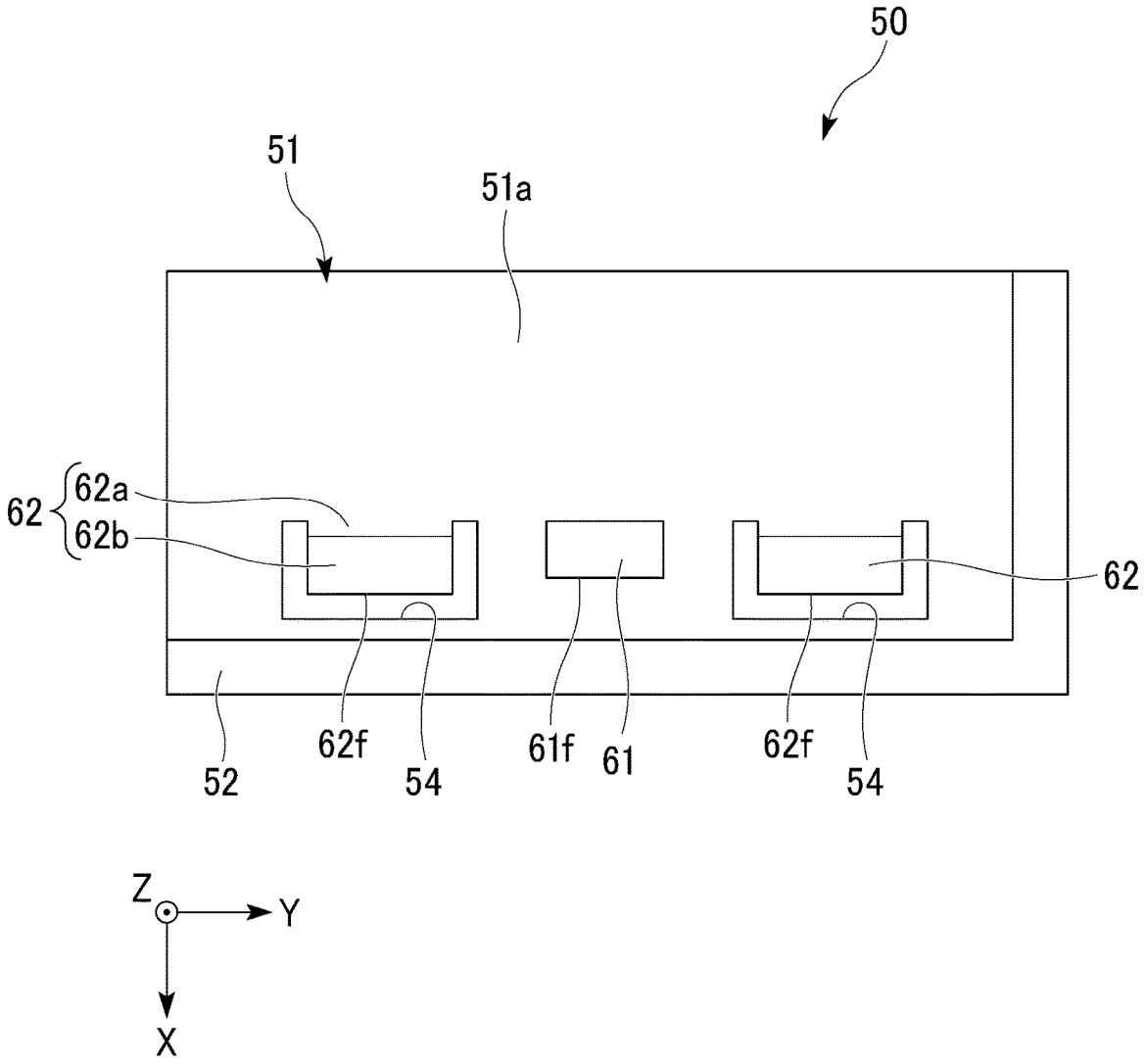
FIG. 8 A view of the gripping members in the first embodiment as seen from the top side.

FIG. 3 is a perspective view that shows a part out of parts of the outdoor unit 10 where a gripping member 50 is attached. FIG. 4 is a perspective view that shows the gripping member 50. FIG. 5 is a view of the gripping member 50 as seen from the front side (+X side). FIG. 6 is a cross-sectional view that shows the gripping member 50, and corresponds to the cross-sectional line VI-VI in FIG. 5. FIG. 7 is a cross-sectional view that shows the gripping member 50, and corresponds to the cross-sectional line VII-VII in FIG. 5. FIG. 8 is a view of the gripping member 50 as seen from the top side.

The gripping members 50 shown in FIG. 3 to FIG. 8 are gripping members 50 that are provided in the corner portions out of portions of the housing 11 to which the front side (+X side) wall portion and the one side of the width direction (+Y side) wall portion are connected to. The corner portions, to which the gripping members 50 are attached, shown in FIG. 3 to FIG. 8 are provided on the front surface panel 11*a*. Although the four gripping member 50 are each attached in differing locations and orientations, each have the same construction. For such reason, the relative positional relationship and the like of the gripping member 50 attached to the front surface panel 11*a*, as a representative of the four gripping members 50, is described in the explanation of the gripping member 50 below.

As shown in FIG. 3, the gripping member 50 is attached to an opening 11*d* that is provided in the housing 11. The opening 11*d* penetrates the wall portion that configures the housing 11. The opening 11*d* shown in FIG. 3 is provided so as to extend over the front wall portion 11*b* and the side wall portion 11*c* in the front surface panel 11*a*. An opening direction of the opening 11*d* in the first embodiment is a direction that is orthogonal to the vertical direction Z. In other words, the vertical direction Z is orthogonal to the opening direction of the opening lid. The opening lid shown in FIG. 3 opens to the front side (+X side) and to the one side of the width direction (+Y side). The opening 11*d* is covered by attaching the gripping member 50. A protrusion 11*e* that protrudes to the inside of housing 11 is provided on an inner edge of the opening 11*d*, as shown in FIG. 6 and FIG. 7. The protrusion 11*e* is at least provided on the portions out of portions of the inner edge of the opening 11*d* that face a plurality of claws 60, to be mentioned later on.

As shown in FIG. 4 to FIG. 8, the gripping member 50 has a main body 51 and a frame body 52. The main body 51 is roughly a rectangular box-shape that opens to the front side (+X side) and to the one side of the width direction (+Y side). As shown in FIG. 6 and FIG. 7, the main body 51 is housed on the inside of housing 11.

The main body 51 has an upper wall portion 51*a*, a bottom wall portion 51*b*, an inner wall portion 51*c*, and a side wall portion 51*d*. Out of wall portions of the main body 51, the upper wall portion 51*a* is the wall portion that is located on the top side. Out of wall portions of the main body 51, the bottom wall portion 51*b* is the wall portion that is located on the bottom side. Out of wall portions of the main body 51, the inner wall portion 51*c* is the wall portion located on the back side (−X side). Out of wall portions of the main body 51, the side wall portion 51*d* is the wall portion located on the other side of the width direction (−Y side).

As shown in FIG. 4, the upper wall portion 51*a* has through holes 54 that penetrate the upper wall portion 51*a* in the vertical direction Z. A pair of through holes 54 are provided at an interval in the width direction Y in the first embodiment. The through holes 54 are provided on the front side (+X side) portion of the upper wall portion 51*a*. As shown in FIG. 8, the through holes 54 are roughly long rectangular shapes in the width direction Y, as seen from the vertical direction Z. Edges of the front side of the through holes 54 are disposed so as to be spaced apart in the back side (−X side) more than the edge of the front side of the upper wall portion 51*a*.

As shown in FIG. 6 and FIG. 7, the frame body 52 is connected to the opening edge 51*e* of the main body 51. The frame body 52 is a frame shape along the opening edge 51*e* of the main body 51. The frame body 52 protrudes from the opening edge 51*e* of the main body 51 to the outside over the entire circumference of the opening edge 51*e*. The frame body 52 is located on the outside of housing 11. Out of parts of the frame body 52, the parts that protrude to the outside more than the main body 51 are coming into contact with, and hook onto, a circumferential edge of the opening 11*d* from an outside of housing 11, out of the outside surfaces of the housing 11. The circumferential edge of the opening 11*d* is sandwiched between the plurality of claws 60 to be mentioned later on, and the frame body 52.

As shown in FIG. 4, the frame body 52 has a first portion 52*a* that is connected to front side (+X side) of the main body 51, and a second portion 52*b* that is connected to the one side of the width direction (+Y side) of the main body 51. The first portion 52*a* protrudes to both sides of the vertical direction Z and to the other side of the width direction (−Y side) more than the main body 51. The second portion 52*b* extends to the back side (−X side) from an end portion of the one side of the width direction of the first portion 52*a*. The second portion 52*b* protrudes to both sides of the vertical direction Z and the back side more than the main body 51.

The inside of frame body 52 is an insertion opening 52*c* that is connected to the inside of main body 51. The frame body 52 has a cover portion 52*d* that covers atop side portion out of portions of the opening of the main body 51. A hand insertion space 53 (inside space) is configured by the main body 51 and the frame body 52. The hand insertion space 53 is a space into which the operator is able to hook their hands or fingers to when transporting the outdoor unit 10. The hand insertion space 53 opens to the outside of housing 11 via the insertion opening 52*c*. The hand insertion space 53 is a space that is provided on the inside of the main body 51. The operator transporting the outdoor unit 10 inserts their hands or fingers in the hand insertion space 53 and holds the cover portion 52*d*. Therefore, it is possible for the operator to lift the outdoor unit 10 by holding onto the gripping member 50.

As shown in FIG. 6, the gripping member 50 has the plurality of claws 60. The plurality of claws 60 protrude from the main body 51. The plurality of claws 60 are located on the inside of housing 11. The plurality of claws 60 are disposed so as to face the circumferential edge of the openings 11*d* in the inside of housing 11. The plurality of claws 60 are disposed so as to face an inner end portion of the protrusion 11*e* that is provided in the opening 11*d*. The plurality of claws 60 hook onto the circumferential edge of the openings 11*d* from the inside of the housing 11.

As shown in FIG. 5, the plurality of the claws 60 include first claw portions 60*a*, and second claw portions 60*b*. The first claw portions 60*a* are claws 60 that are provided on the top side of the main body 51. The second claw portions 60*b* are claws 60 that are provided on the bottom side of the main body 51. In other words, the second claw portions 60*b* are provided on the opposite side of the first claw portions 60*a* in the vertical direction Z. Each of a plurality of first claw portions 60*a* and of second claw portions 60*b* are provided in the first embodiment. The plurality of first claw portions 60*a* protrude to the top side from the upper wall portion 51*a* of the main body 51. The plurality of the second claw portions 60*b* protrude to the bottom side from the bottom wall portion 51*b* of the main body 51.

The first claw portions 60*a* include a fixed claw 61, and elastic claws 62. The fixed claw 61 and the elastic claws 62 protrude to the top side from the upper wall portion 51*a* of the main body 51. As shown in FIG. 8, the fixed claw 61 in the first embodiment is provided between a pair of through holes 54 on a portion out of portions of the upper wall portion 51*a* in the width direction Y The fixed claw 61 is located on a center portion of the upper wall portion 51*a* in the width direction Y A bottom end portion of the fixed claw 61 is entirely connected to the upper wall portion 51*a*. As shown in FIG. 4 and FIG. 6, the fixed claw 61 is roughly a triangular shape, as seen from the width direction Y The protrusion height of the fixed claw 61 with respect to the main body 51 becomes larger as the fixed claw 61 approaches the front side (+X side) of the main body 51. The protrusion height of the fixed claw 61 with respect to the main body 51 is a vertical direction Z dimension of the fixed claw 61, and represents a distance between a top surface of the upper wall portion 51*a* and a top end portion of the fixed claw 61 in the vertical direction Z. The top end portion of the fixed claw 61 in the first embodiment is located more to the bottom side than the top end portion of the frame body 52.

As shown in FIG. 6, the fixed claw 61 has a first facing surface 61*f* that faces the circumferential edge of the openings 11*d*, and a first inclined surface 61*i*. The first facing surface 61*f* faces the front side (+X side). The first facing surface 61*f* is a surface that is roughly parallel with the vertical direction Z. For example, although not shown in the figures, the first facing surface 61*f* is a surface that slightly inclines towards a direction located in the back side with respect to the vertical direction Z as the first facing surface 61*f* approaches the top side. The first facing surface 61*f* faces the inner end portion of protrusion 11*e* in the first embodiment. The first facing surface 61*f* contacts the inner end portion of protrusion 11*e*. The first inclined surface 61*i* is a surface that faces the back side, and faces an inclined top side. Atop end portion of the first inclined surface 61*i* is connected to a top end portion of the first facing surface 61*f*. The first inclined surface 61*i* becomes located on the top side as the first inclined surface 61*i* moves towards the front side.

When the first facing surface 61*f* is hooked onto the protrusion 11*e*, the fixed claw 61 is hooked from the inside of housing 11 to the circumferential edge of the openings 11*d*. A portion out of portions of the circumferential edge of the openings 11*d* that is located on the top side is sandwiched in the front-back direction X by a portion that protrudes to the top side more than the main body 51 out of portions of the frame body 52, and by the fixed claw 61.

As shown in FIG. 4, the elastic claws 62 in the first embodiment are provided in a pair that sandwiches the fixed claw 61 in the width direction Y on the upper wall portion 51*a*. Each elastic claw 62 in the pair of elastic claws 62 has the same shape. The pair of elastic claws 62 are each disposed inside the pair of through holes 54. The pair of elastic claws 62 are each cantilevered by an inner edge of each of the pair of through holes 54. An end of each of the elastic claw 62 in the back side (−X side) is connected to a portion out of portions of the through holes 54 that is located to the back side of the inner edge of each of the through holes 54. In other words, the elastic claws 62 in the first embodiment are connected from the opening 11*d* out of the inner edges of through hole 54, to an edge of a far side of through hole 54. Therefore, each of the elastic claws 62 is cantilevered by the main body 51. A gap is provided on the edges of both sides of the width direction between the elastic claws 62 and the through holes 54, and on the edge of the front side between the elastic claws 62 and the through holes 54.

As shown in FIG. 7, an elastic claw 62 of the elastic claws 62 has a support portion 62*a* and a claw main body 62*b*. The support portions 62*a* in the first embodiment are plate shapes that have plate surfaces which face the vertical direction Z. The support portions 62*a* are located inside the through holes 54. The support portions 62*a* extend from the portion out of portions of inner edges of each of the through holes 54 that is located on the back side (−X side) to the front side (+X side). An end of the support portions 62*a* front side is disposed so as to face the back side of the portion that is located on the front side of the through holes 54 out of portions of the inner edges of the through holes 54, with a gap in between.

The claw main bodies 62*b* protrude to the top side from the portion in the front side (+X side) of the support portions 62*a*. The claw main bodies 62*b* protrude to the top side more than the through holes 54. The claw main bodies 62*b* are roughly triangular shapes, as seen from the width direction Y Protrusion heights of the claw main bodies 62*b* with respect to the main body 51 become larger as the claw main bodies 62*b* approach the front side of the main body 51. The protrusion heights of the claw main bodies 62*b* with respect to the main body 51 are vertical direction Z dimensions of the claw main bodies 62*b*, and are protrusion heights of the elastic claws 62 with respect to the main body 51. The protrusion heights of the elastic claws 62 with respect to the main body 51 represent distances between the top surface of the upper wall portion 51*a* and top end portions of the elastic claws 62 in the vertical direction Z.

As shown in FIG. 5, top end portions of the elastic claws 62 in the first embodiment, in other words the top end portions of the claw main bodies 62*b*, are located on the top side more than the top end portion of the fixed claw 61. In other words, the protrusion height of the fixed claw 61 with respect to the main body 51 is less than the protrusion heights of the elastic claws 62 with respect to the main body 51. The top end portions of the elastic claws 62 are located in the bottom side more than the top end portion of the frame body 52.

As shown in FIG. 7, the elastic claws 62 have second facing surfaces 62*f* that face the circumferential edge of the openings 11*d*, and second inclined surfaces 62*i*. The second facing surfaces 62*f* face the front side (+X side). The second facing surfaces 62*f* are surfaces that are roughly parallel with the vertical direction Z. For example, although not shown in the figures, the second facing surfaces 62*f* are surfaces that slightly incline towards a direction located in the back side with respect to the vertical direction Z as the second facing surfaces 62*f* approach the top side. The second facing surfaces 62*f* are connected to the top side of the support portions 62*a* front side surface. The second facing surfaces 62*f* in the first embodiment face inner end portion of the protrusion 11*e*. The second facing surfaces 62*f* are in contact with the inner end portion of the protrusion 11*e*. The second inclined surfaces 62*i* are surfaces that face the back side (−X side), and incline towards the top side. The second inclined surfaces 62*i* top sides are connected to the second facing surfaces 62*f* top sides. The second inclined surfaces 62*i* become located on the top side as the second inclined surfaces 62*i* move towards the front side.

When the second facing surfaces 62*f* are hooked to the protrusion 11*e*, the elastic claws 62 are hooked from the inside of the housing 11 to the circumferential edge of the openings 11*d*. A portion out of portions of the circumferential edge of the openings 11*d* that is located on the top side is sandwiched in the front-back direction X by a portion that protrudes to the top side more than the main body 51 out of portions of the frame body 52, and by the elastic claws 62.

As shown in FIG. 8, a dimension of the elastic claws 62 in the width direction Y is greater than a dimension of the fixed claw 61 in the width direction Y Surfaces of the elastic claws 62 front sides (+X side) are located slightly more to the front side than a surface of the fixed claw 61 front side. In other words, the second facing surfaces 62*f* are located on a side closer to the circumferential edge of the openings 11*d* than the first facing surface 61*f*.

The elastic claws 62 deform elastically in the vertical direction Z with respect to the main body 51. Specifically, by making connection portions of the inner edges of the through holes 54 in the support portions 62*a* elastically deformable in the vertical direction Z, it is possible to have the elastic claws 62 elastically deform in the vertical direction Z with the connection portions of the support portions 62*a* and the inner edges of the through holes 54 as a pivot.

As shown in FIG. 5, the second claw portions 60*b* include fixed claws 63. The fixed claws 63 protrude to the bottom side from the bottom wall portion 51*b* of the main body 51. A pair of fixed claws 63 in the first embodiment is provided in the width direction Y with a space in between. The pair of fixed claws 63 are each disposed in a location that overlaps with the pair of elastic claws 62 as seen from the vertical direction Z. Top end portions of the fixed claws 63 are entirely connected to the bottom wall portion 51*b*. As shown in FIG. 7, the fixed claws 63 are roughly shaped as isosceles triangles, as seen from the width direction Y Protrusion heights of the fixed claws 63 with respect to the main body 51, in other words the protrusion heights of the second claw portions 60*b* with respect to the main body 51, are greater than the protrusion heights of the elastic claws 62 with respect to the main body 51. The protrusion heights of the fixed claws 63 with respect to the main body 51 in the first embodiment are greater than the protrusion heights of elastic claws 62 with respect to the main body 51. The protrusion heights of the fixed claws 63 with respect to the main body 51 are vertical direction Z dimensions of the fixed claws 63, and represent distances between a bottom surface of the bottom wall portion 51*b* and a bottom end portions of fixed claws 63 in the vertical direction Z. The bottom end portions of fixed claws 63 in the first embodiment are located more to the bottom side than a bottom end portion of frame body 52.

The fixed claws 63 have third facing surfaces 63*f* that face the circumferential edge of the openings 11*d*. The third facing surfaces 63*f* face the front side (+X side). The third facing surfaces 63*f* are surfaces that incline towards a direction located in the back side (−X side) with respect to the vertical direction Z as the third facing surfaces 63*f* approach the bottom side. The third facing surfaces 63*f* face the inner end portion of the protrusion 11*e* in the first embodiment. The third facing surfaces 63*f* contact the inner end portion of the protrusion 11*e*. A surface on the back side of the fixed claws 63 is symmetrically disposed to the third facing surfaces 63*f* in the front back direction X.

When the third facing surfaces 63*f* are hooked onto the protrusion 11*e*, the third facing surfaces 63*f* are hooked from the inside of the housing 11 to the circumferential edge of the openings 11*d*. A portion out of portions of the circumferential edge of the openings 11*d* that is located on the bottom side is sandwiched in the front-back direction X by a portion that protrudes to the bottom side more than the main body 51 out of portions of the frame body 52, and by the fixed claws 63.

Figure 9:
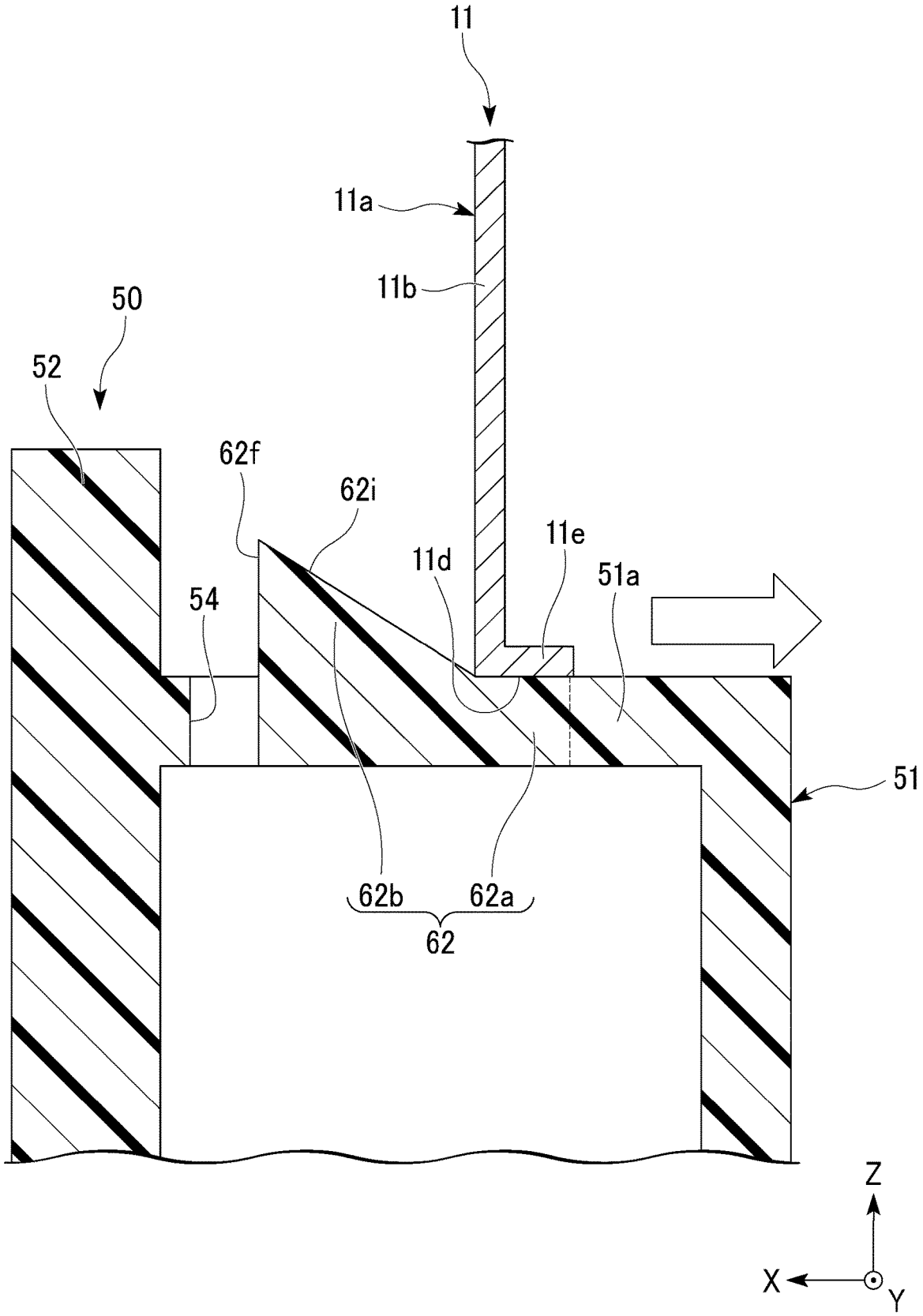
FIG. 9 A cross-sectional view that shows a portion of attachment procedures of the gripping member to a housing in the first embodiment.
Figure 10:
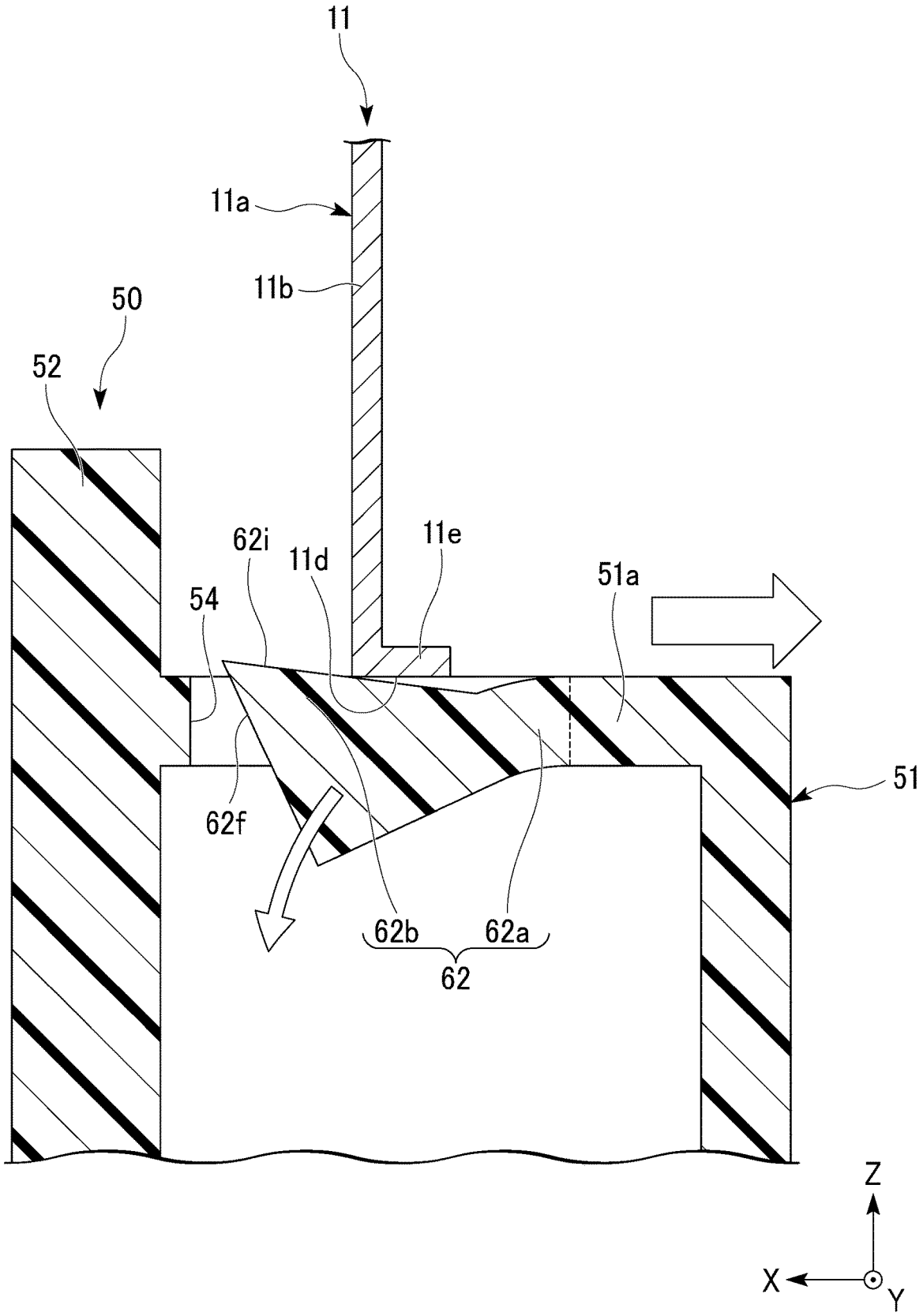
FIG. 10 A cross-sectional view that shows another portion of the installation procedures of the gripping member to the housing in the first embodiment.

FIG. 9 is a cross-sectional view that shows a portion of attachment procedures of the gripping member 50 to the housing 11. FIG. 10 is a cross-sectional view that shows another portion of the attachment procedures of the gripping member 50 to the housing 11 in the first embodiment. The operator attaching the gripping members 50 to the housing 11 brings the gripping members 50 close to the openings 11*d* from an outside of the housing 11. The operator then tilts the gripping member 50 with respect to the vertical direction Z, and inserts the fixed claws 63 provided on a bottom side portion of the main body 51 and on the bottom side of the main body 51 to an inside of the openings 11*d*.

In a state where the fixed claws 63 are hooked to circumferential edge of the openings 11*d* on the inside of the housing 11, the operator inserts the top side portion of the main body 51 as shown in FIG. 9 to the inside of the openings 11*d*, straightening out the tilt of the gripping members 50 with respect to the vertical Z direction. In FIG. 9 and in FIG. 10, although a state where the top side portion of the main body 51 is moved straight in the back side (−X side) and is inserted to the inside of the opening 11*d*, it is possible to insert the top side portion of the main body 51 to the inside of the opening 11*d* by rotating the gripping members 50, with the bottom side portion of the gripping members 50 that are hooked onto the opening 11*d* as a pivot.

After inserting the top side portion of the main body 51 to the inside of the opening 11*d*, the second inclined surfaces 62*i* of the elastic claws 62 contact the circumferential edge of the top side of the opening 11*d*. In this state, when the gripping members 50 are further pressed into the openings 11*d*, as shown in FIG. 10, the second inclined surfaces 62*i* are pressed by the circumferential edge of the openings 11*d*, and the elastic claws 62 deform in the direction (−Z direction) in which the elastic claws 62 are push-inserted to the inside of the main body 51, where the connection portions of the support portions 62*a* and the inner edges of the through holes 54 act as pivots. Therefore, it is possible to decrease the protrusion heights of elastic claws 62 with respect to the main body 51, and to easily insert the elastic claws 62 to the inside of the openings 11*d*.

When the main body 51 is further pressed to the inside of opening 11*d*, the elastic claws 62 entirely pass through the opening 11*d*, causing the elastically deformed support portions 62*a* to restore, and the elastic claws 62 return to the original state of the elastic claws 62. Therefore, the second facing surfaces 62*f* of the elastic claws 62 are in a state where the second facing surfaces 62*f* of the elastic claws 62 face the inner end portion of the protrusion 11*e*, and the elastic claws 62 are hooked onto the circumferential edge of the openings 11*d* from the inside of the housing 11.

As previously mentioned, when the gripping members 50 are push-inserted to the inside of the openings 11*d*, as with elastic claws 62, the fixed claw 61 provided on the top side of the main body 51 also contacts the edge of the top side of the openings 11*d*. In such case, the protrusion height of the fixed claw 61 is less than the protrusion heights of elastic claws 62. As such, when push-inserting a gripping member 50 of the gripping members 50 to the inside of opening 11*d*, by having at least one of the inner edge of the opening 11*d* or the fixed claw 61 slightly deform elastically, the fixed claw 61 is inserted into the housing 11 through the opening lid. After the fixed claw 61 passes through the opening lid, the elastically deformed portion is restored, and the first facing surface 61*f* of the fixed claw 61 faces the inner end portion of protrusion 11*e*. Therefore, the fixed claw 61 is hooked onto the circumferential edge of the openings 11*d* from the inside of the housing 11.

As shown above, it is possible to attach the gripping members 50 to the openings 11*d* of the housing 11 by push-inserting the gripping members 50 to the inside of the openings 11*d* from the outside of the housing 11. In a state where the gripping members 50 are attached to the housing 11, the circumferential edge of the openings 11*d* is sandwiched by the plurality of claws 60 and by the frame body 52. Therefore, it is possible to suppress the gripping members 50 from coming off of the opening 11*d*.

In a case where conventional gripping members are inserted and attached to the openings 11*d* from the outside of housing 11, as with the gripping members 50 mentioned above, after inserting the claws provided on one side in the vertical direction Z to the inside of the openings 11*d*, all of the claws that are provided on the other side in the vertical direction Z are pressed into the inside of the openings 11*d*, as with fixed claws 61 previously mentioned. In other words, at least one of the inner edges of the openings 11*d* and all of the claws provided in the other side in the vertical direction Z is slightly deformed elastically when push-inserting the above claws to the inside of openings 11*d*. In such case, when the height of protrusions of the elastically deformable claws that are push-inserted are large, it is not possible to push and insert the claws with the claws being hooked onto the inner edges of the openings 11*d* to the inside of the openings 11*d*, and there is a need to decrease the size of the protrusion heights of the claws. As such, when push-inserting and attaching the conventional gripping members to the inside of openings 11*d* from the outside of housing 11, it is difficult for the claws to have enough protrusion heights, and so attaching the gripping members firmly with respect to the housing 11 is difficult.

In contrast to the above, the elastic claws 62 according to the first embodiment are provided so as to be cantilevered by the main body 51. The elastic claws 62 are elastically deformable in the vertical direction Z with respect to the main body 51. As such, by elastically deforming the elastic claws 62 as previously mentioned, it is possible to insert the gripping members 50 into the openings 11*d* in a state where the protrusion heights of the elastic claws 62 with respect to the main body 51 are smaller. After the elastic claws 62 pass through the openings 11*d*, the elastic claws 62 restore after deforming, and the protrusion heights of elastic claws 62 with respect to the main body 51 return to the protrusion heights before deforming. As such, even if the protrusion heights of elastic claws 62 are made to be large to some extent, by push-inserting the gripping members 50 into the openings 11*d*, it is possible to easily insert the elastic claws 62 into the housing 11. Therefore, it is possible to make each of protrusion heights of claws 60 provided on both sides in the vertical direction Z of the main body 51 larger, and it is possible to firmly attach the gripping members 50 to the openings 11*d*.

From the above, according to the first embodiment, it is possible to ensure an attachment strength of the gripping members 50, along with improving work efficiency of the gripping members 50. When attaching the gripping members 50, it is possible for the operator to easily confirm the attachment of the gripping members 50 to the openings 11*d* by sounds or feeling and so on that result when the elastic claws 62 restore after deforming. As such, it is possible to increase the work efficiency of the gripping members 50.

By push-inserting the gripping members 50 into the openings 11*d* from the outside of the housing 11, by providing the openings 11*d* in the housing 11 in order to attach the gripping members 50 to the housing 11, it is possible to attach the gripping members 50 to any location of the housing 11. As such, compared to a case where the gripping members 50 are held by being sandwiched between two or more members that configure the housing 11, it is possible to improve a degree of freedom of design of attachment locations of the gripping members 50 in the housing 11. Therefore, it is possible to attach the gripping members 50 to locations where it is easier to hold the gripping members 50, out of locations of the housing 11.

The elastic claws 62 according to the first embodiment are the first claw portions 60*a*. The protrusion heights of the second claw portions 60*b* with respect to the main body 51 are greater than the protrusion heights of the elastic claws 62 with respect to the main body 51. As such, it is possible to increase the protrusion heights of the second claw portions 60*b* to be greater than or equal to the protrusion heights of the elastic claws 62, protrusion heights of that can be relatively great, as previously mentioned. As such, it is possible to appropriately increase each of the protrusion heights of the elastic claws 62, which are the first claw portions 60*a*, and of the second claw portions 60*b*. Therefore, it is possible to firmly attach the gripping members 50 to the openings 11*d*.

According to the first embodiment, the main body 51 has through holes 54 that are configured to penetrate the wall portion of the main body 51. The elastic claws 62 are cantilevered by the inner edges of the through holes 54. As such, it is possible to easily have the elastic claws 62 be cantilevered by the main body 51. It is also possible to easily have the elastic claws 62 elastically deform via the through holes 54.

According to the first embodiment, the elastic claws 62 in the first embodiment are connected to edges, out of the inner edges of through hole 54, of the sides that are far from the opening 11*d*. As such, compared to a case where the elastic claws 62 are connected to the edges closer to the opening 11*d* out of the inner edges of through hole 54, it is easier to have the elastic claws 62 be in a separable orientation from the inner edges of openings 11*d* when push-inserting the gripping members 50 into the openings lid. Therefore, it is possible to elastically deform the elastic claws 62, and it is possible to easily attach the gripping members 50 to the openings 11*d*.

According to the first embodiment, the elastic claws 62 are provided on the top side of the main body 51 in the vertical direction. As such, the through holes 54 are also provided on the upper wall portion 51*a* of the main body 51. Therefore, compared to a case where the through holes 54 are provided on the bottom wall portion 51*b* of the main body 51, it is possible to suppress foreign bodies such as rain water or the like from entering through the through holes 54 to the housing 11.

According to the first embodiment, the plurality of first claw portions 60*a* are provided. The plurality of first claw portions 60*a* include the fixed claws 61 and the elastic claws 62. As such, along with the elastic claws 62, it is possible to also hook the fixed claws 61 to the circumferential edge of the opening 11*d*. As such, it is possible to attach the gripping members 50 to the openings 11*d* more firmly. The protrusion heights of the fixed claws 61 with respect to the main body 51 are less than the protrusion heights of the elastic claws 62 with respect to the main body 51. Therefore, even if the fixed claws 61 are not configured so as to be cantilevered, such as the case of the elastic claws 62, it is possible to push-insert the fixed claws 61 into the opening 11*d*. By providing the fixed claws 61 so as not to be cantilevered, a force applied to the gripping members 50 when the outdoor unit 10 is transported or the like is not only absorbed by the elastic claws 62, but by the fixed claws 61 as well. As such, it is possible to prevent excess load from being applied to the elastic claws 62. Therefore, it is possible to prevent concentration of stresses on portions out of the elastic claws 62 that are connected to the through holes 54, in other words a base portion of the support portions 62*a*, and it is possible to prevent the elastic claws 62 from being damaged.

According to the first embodiment, the second facing surfaces 62*f* of the elastic claws 62 are located on a side closer to the circumferential edge of the openings 11*d* than the first facing surfaces 61*f* of the fixed claws 61. As such, in a case where the gripping members 50 are pulled to the outside of the housing 11 during transport or the like of the outdoor unit 10, it is possible to have the second facing surfaces 62*f* of the elastic claws 62 to come into contact with the circumferential edge of openings 11*d* before the first facing surface 61*f* of the fixed claws 61. As such, it is possible to prevent the fixed claws 61 from coming out from the openings 11*d*. Therefore, it is possible to attach the gripping members 50 more securely to the openings 11*d* than the conventional gripping members. When attaching the gripping members 50 to the openings 11*d*, the fixed claws 61 pass through the openings 11*d* before the elastic claws 62 pass through the openings 11*d*. As such, after passing the elastic claws 62 through the openings 11*d* and confirming that the elastic claws 62 have restored after deforming through sounds or feeling or the like, the fixed claws 61 are in a state where the fixed claws 61 have passed through the openings 11*d*. Therefore, by being able to confirm that the elastic claws 62 have passed through the openings 11*d* through sounds or feeling or the like, it is easy to confirm appropriate attachment of the gripping members 50 with respect to the housing 11.

According to the first embodiment, the plurality of first claw portions 60*a* include a plurality of elastic claws 62. As such, it is possible to firmly attach the gripping members 50 to the openings 11*d* by the plurality of elastic claws 62. Compared to a case where a dimension of one of the elastic claws 62 in the width direction Y is made larger so as to improve the attachment strength of the gripping members 50, it is possible to make the dimension of each of the elastic claws 62 in the width direction Y smaller, making it easy to elastically deform each of the elastic claws 62. Therefore, it is possible to easily attach the gripping members 50 to the openings lid.

According to the first embodiment, the gripping members 50 have the frame body 52 along the frame of the opening edge 51*e* of the main body 51. The frame body 52 is located on the outside of the housing 11, and sandwiches the circumferential edge of the openings 11*d* in between with the plurality of claws 60. As such, it is possible to stably sandwich the circumferential edge of the openings 11*d*, and to more firmly attach the gripping members 50 to the openings 11*d* by the frame body 52 and the plurality of claws 60.

According to the first embodiment, the heat exchange unit that includes the gripping members 50 provided with the elastic claws 62 is the outdoor unit 10. The mass of the outdoor unit 10 is greater, compared to the indoor unit 20. As such, the outdoor unit 10 is harder to transport, compared to the indoor unit 20. With respect to the above, by providing the gripping members 50 that ensures the previously mentioned attachment strength, it is possible to easily transport the outdoor unit 10 via the gripping members 50.

According to the first embodiment, top end portions of first claw portions 60*a* are located in the bottom side more than top end portions of frame body 52. Bottom end portions of the second claw portions 60*b* are located more to the bottom side than the bottom end portions of frame body 52. As such, the first claw portions 60*a* are hidden and are not visible by the frame body 52, as seen from the front side (+X side) of the gripping members 50. On the other hand, the bottom end portions of the second claw portions 60*b* protrude to the bottom side more than the frame body 52. As such, the bottom end portions of the second claw portions 60*b* are visible from the front side before attaching the gripping members 50 to the housing 11. Therefore, the operator attaching the gripping members 50 is able to easily grasp an orientation of the gripping members 50 when attaching the gripping members 50 to the housing 11 since the second claw portions 60*b* that protrude more than the frame body 52 are visible.

According to the first embodiment, a surface out of surfaces of the elastic claws 62 that is located on an opposite side to the surface where the opening 11*d* is located on, is the second inclined surfaces 62*i* which is inclined with respect to the vertical direction Z. As such, when push-inserting the gripping members 50 into the openings lid, the circumferential edge of the openings 11*d* contact the second inclined surfaces 62*i*. Therefore, when push-inserting the gripping members 50 into the openings 11*d*, it is difficult for the elastic claws 62 to get hooked onto the circumferential edge of the openings 11*d*, and it becomes easier to elastically deform the elastic claws 62. It is also difficult to apply an excessive force to the circumferential edge of the openings 11*d*. Therefore, it is possible to prevent deformation of the openings 11*d*.

Second Embodiment

Figure 11:
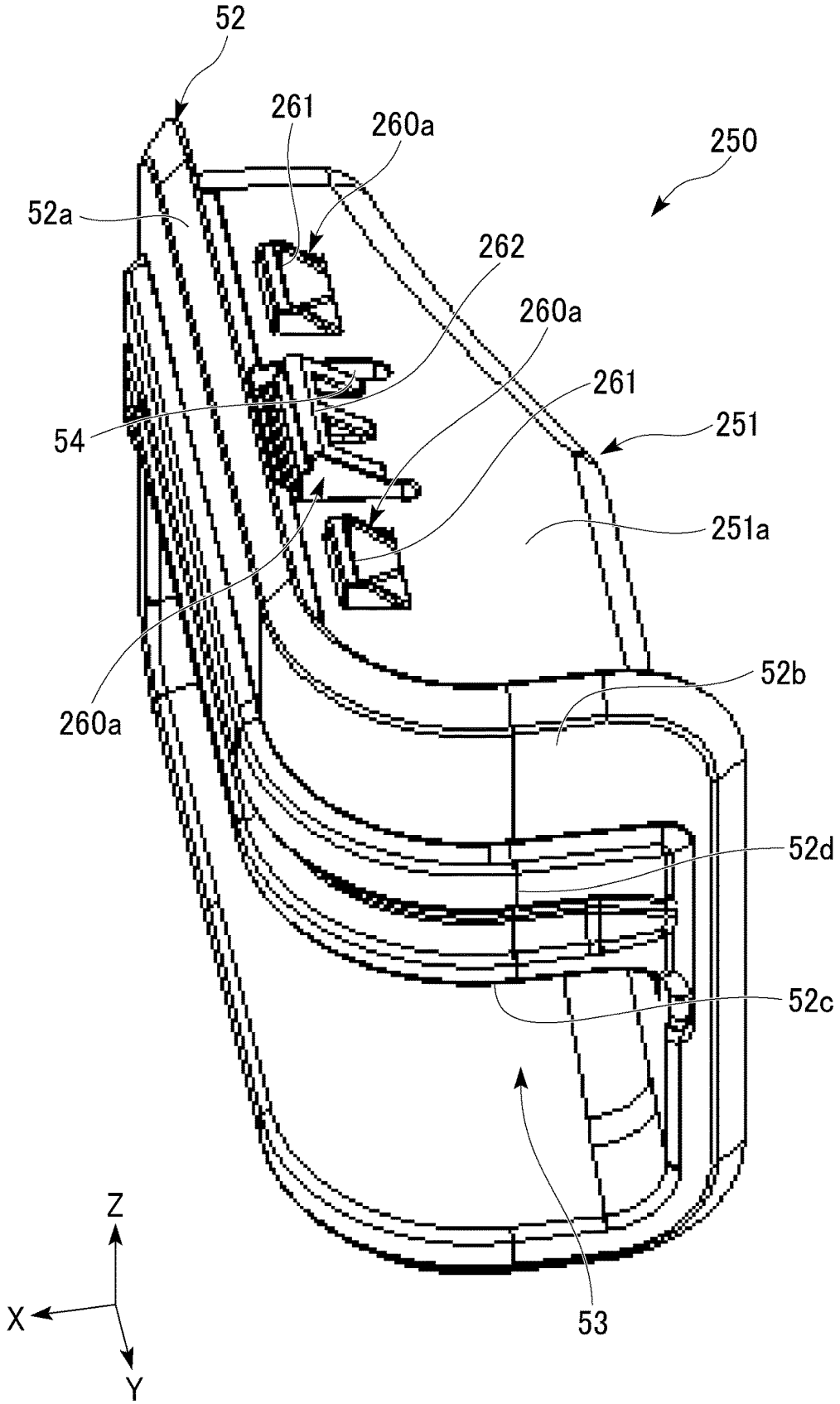
FIG. 11 A perspective view that shows the gripping members in a second embodiment.
Figure 12:
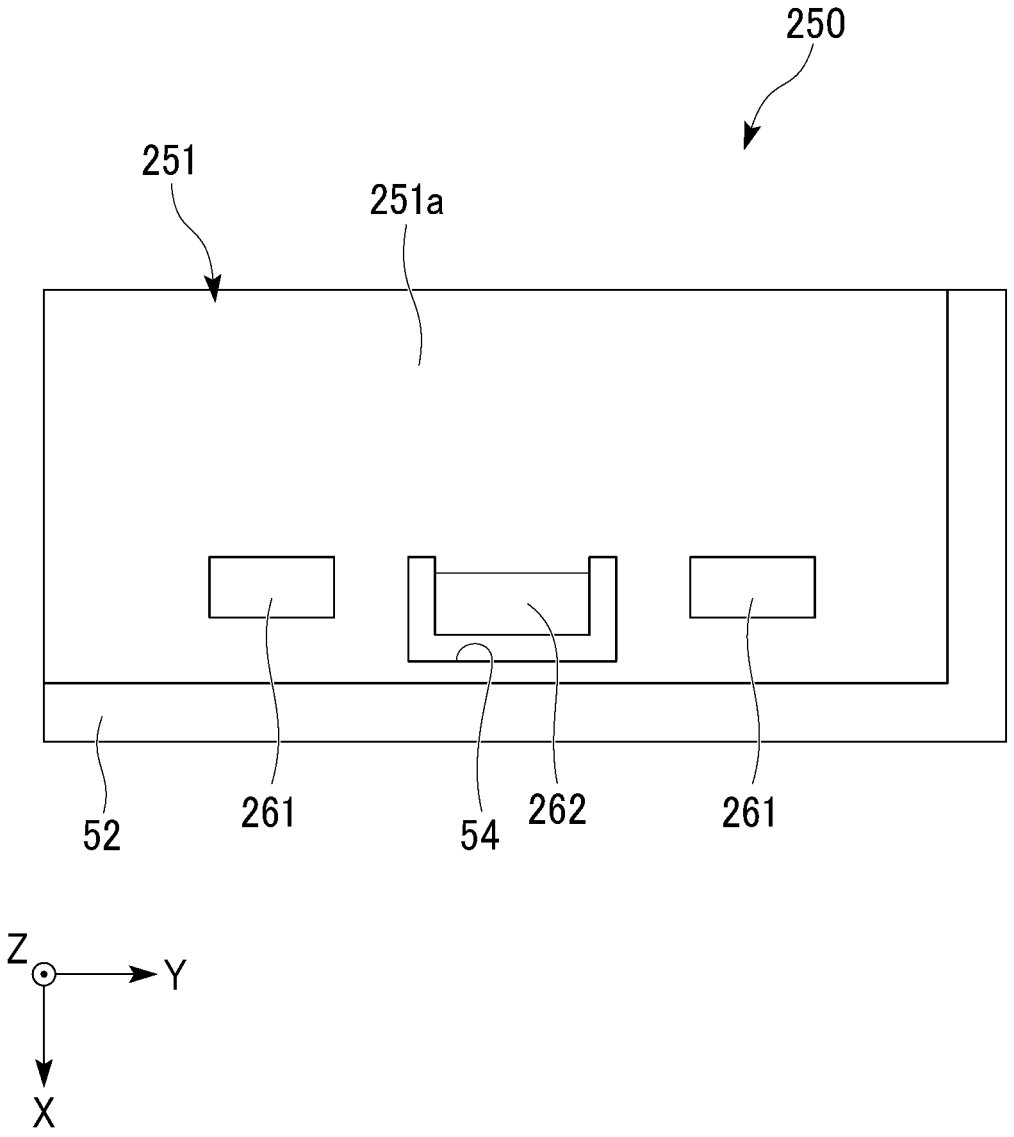
FIG. 12 A view of the gripping members in the second embodiment as seen from the top side.

FIG. 11 is a perspective view that shows gripping members 250 in a second embodiment. FIG. 12 is a view of a gripping member 250 in the second embodiment as seen from the top side. In the explanation below, configurations similar to the configurations previously mentioned have the same reference symbols appropriated, and thus the explanations thereof are omitted.

As shown in FIG. 11 and in FIG. 12, the gripping members 250 in the second embodiment have an upper wall portion 251*a* of main body 251. In contrast to the upper wall portion 51*a* of the first embodiment, the upper wall portion 251*a* of the main body 251 only has one through hole 54 in a center portion of the upper wall portion 251*a* in the width direction Y Another configuration of the main body 251 is similar to another configuration of the main body 51 in the first embodiment.

A plurality of first claw portions 260*a* in the gripping members 250 includes two fixed claws 261 and one elastic claw 262. The one elastic claw 262 is provided in the one through hole 54. The two fixed claws 261 are disposed so as to sandwich the one elastic claw 262 in the width direction Y. Another configuration of the fixed claws 261 is similar to another configuration of the fixed claws 61 of the first embodiment. Another configuration of an elastic claw 262 is similar to another configuration of the elastic claws 62 of the first embodiment. Another configuration of the gripping members 250 is similar to another configuration of the gripping members 50 of the first embodiment.

According to the second embodiment, the plurality of first claw portions 260*a* includes the plurality of fixed claws 261 and the one elastic claw 262. As such, it is possible to appropriately receive the stresses that are applied to the elastic claw 262 by the plurality of fixed claws 261.

Therefore, it is possible to prevent damage to the elastic claw 262, as well as appropriately and safely attach the gripping members 250 to the openings lid. When attaching the gripping members 250, when it is possible to confirm through sounds or feeling or the like whether the one elastic claw 262 has restored inside of housing 11 after deforming and is hooked onto the circumferential edge of the opening 11*d*, it is then possible to confirm that the gripping members 250 are correctly attached to the openings 11*d*. In other words, if it is possible to insert one elastic claw 262 into the housing 11 correctly, there is no need to confirm whether the other elastic claws 262 have been inserted into the housing 11 correctly or not. As such, it is possible to prevent attachment of the gripping members 250 to the housing 11 in a state where the elastic claws 262 are elastically deformed on the inside of opening 11*d*. Therefore, it is possible to appropriately and easily attach the gripping members 250 to the openings 11*d*.

Third Embodiment

Figure 13:
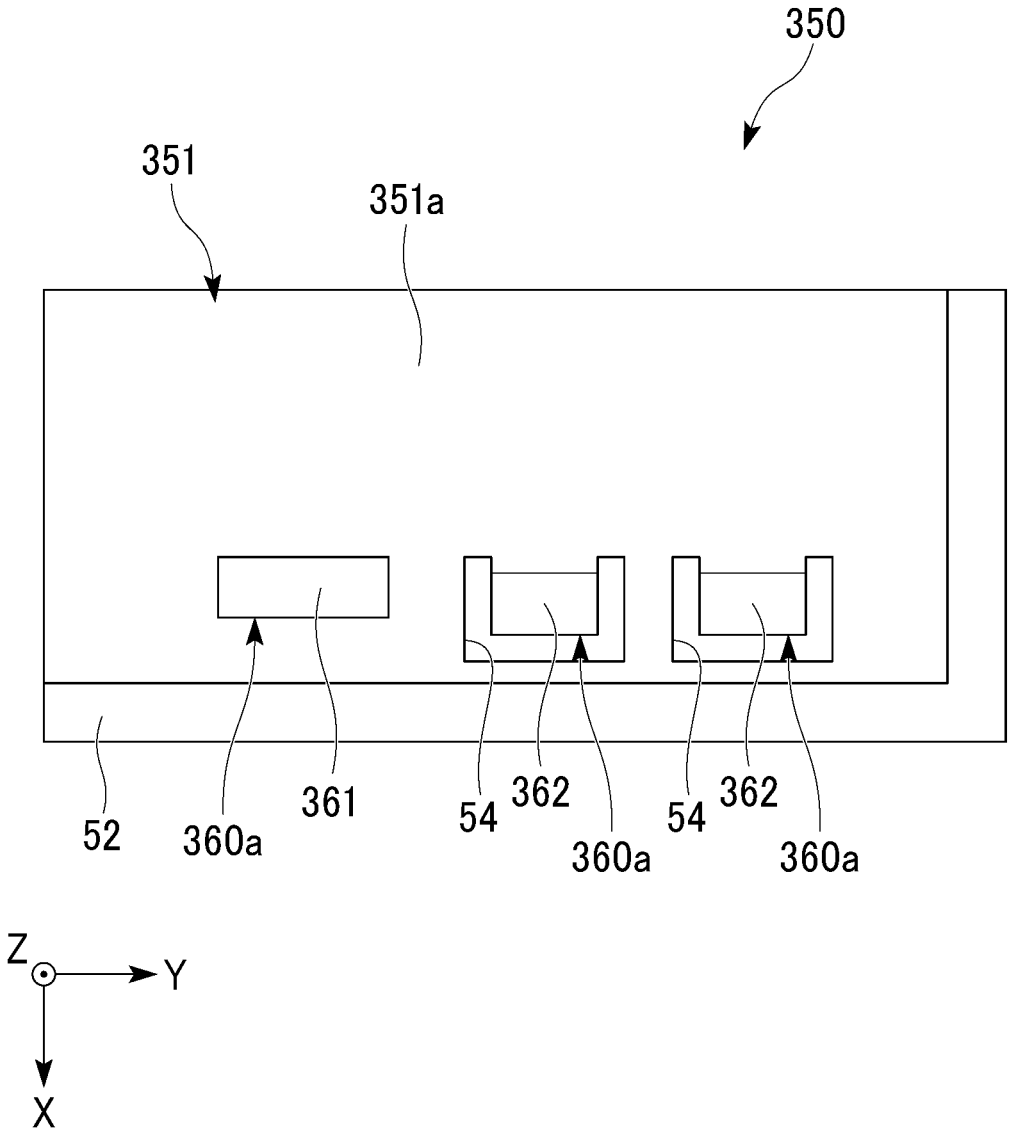
FIG. 13 A view of the gripping members in a third embodiment as seen from the top side.

FIG. 13 is a view of gripping members 350 in a third embodiment as seen from the top side. In the explanation below, configurations similar to the configurations previously mentioned have the same reference symbols appropriated, and thus the explanations thereof are omitted.

As shown in FIG. 13, except that two through holes 54 have different dispositions on an upper wall portion 351*a*, a main body 351 in the gripping members 350 of the third embodiment has a similar configuration as the configuration of the main body 51 in the first embodiment.

A plurality of first claw portions 360*a* includes one fixed claw 361, and two elastic claws 362. The one fixed claw 361 is disposed adjacently to the two elastic claws 362 in the other side of the width direction (−Y side). The two elastic claws 362 are disposed adjacently in the width direction Y A dimension of the elastic claws 362 in the width direction Y is less than a dimension of the fixed claw 361 in the width direction Y As such, it is possible for the elastic claws 362 to elastically deform when attaching to the gripping members 350. Therefore, it is possible to easily attach the gripping members 350.

Another configuration of the fixed claw 361 is similar to another configuration of the fixed claw 61 of the first embodiment. Another configuration of the elastic claws 362 is similar to another configuration of the elastic claws 62 of the first embodiment. Another configuration of the gripping members 350 is similar to another configuration of the gripping members 50 of the first embodiment.

Fourth Embodiment

Figure 14:
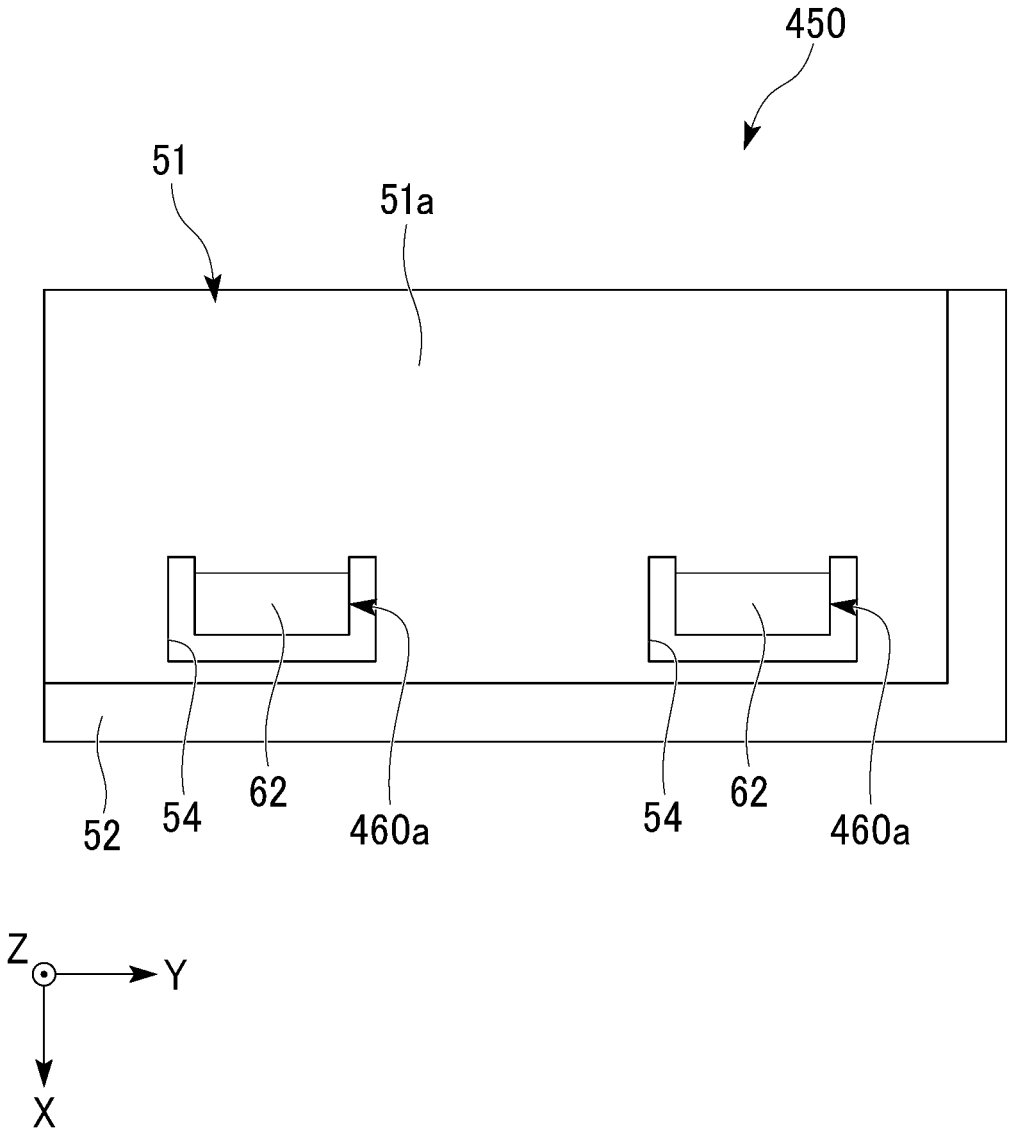
FIG. 14 A view of the gripping members in a fourth embodiment as seen from the top side.

FIG. 14 is a view of gripping members 450 in a fourth embodiment as seen from the top side. In the explanation below, configurations similar to the configurations previously mentioned have the same reference symbols appropriated, and thus the explanations thereof are omitted.

As shown in FIG. 14, a plurality of first claw portions 460*a* includes only two elastic claws 62 in gripping members 450 of the fourth embodiment. Unlike the first embodiment, the plurality of the first claw portions 460*a* do not include the fixed claw 61. As such, compared to a case where the fixed claws 61 are provided, the gripping members 450 are easier to make. Another configuration of the gripping members 450 is similar to another configuration of the gripping members 50 of the first embodiment.

Fifth Embodiment

Figure 15:
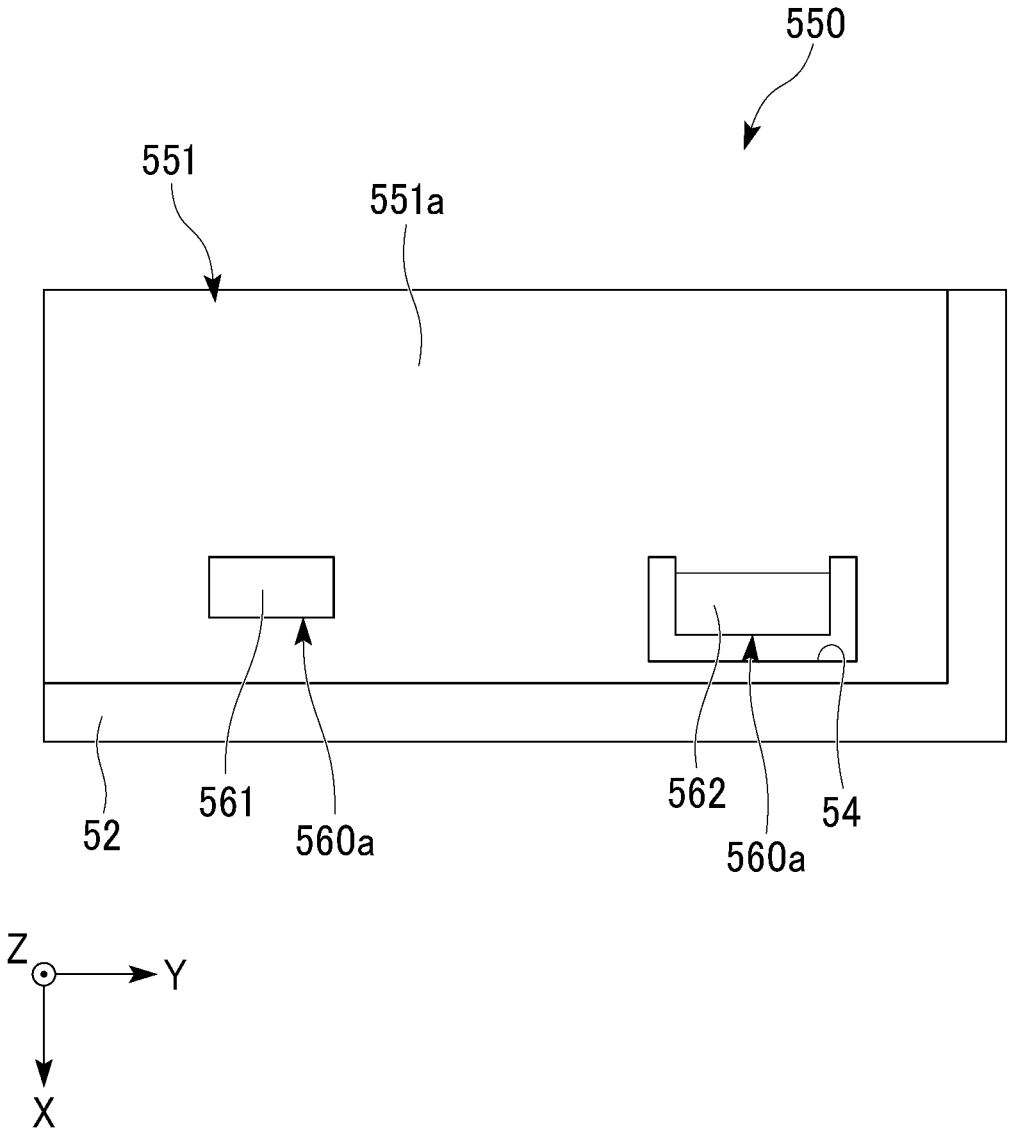
FIG. 15 A view of the gripping members in a fifth embodiment as seen from the top side.

FIG. 15 is a view of gripping members 550 in a fifth embodiment as seen from the top side. In the explanation below, configurations similar to the configurations previously mentioned have the same reference symbols appropriated, and thus the explanations thereof are omitted.

As shown in FIG. 15, except that the one through hole 54 is disposed in the one side of the width direction (+Y side) on an upper wall portion 551*a*, a main body 551 in the gripping members 550 of the fifth embodiment has a similar configuration as the configuration of the main body 251 in the second embodiment. A plurality of first claw portions 560*a* each only include one fixed claw 561 and one elastic claw 562. As such, by decreasing the number of first claw portions 560*a* and making the gripping members 550 easy to make, the attachment strength of the gripping members 550 is improved by the fixed claw 561 and the elastic claw 562. The one fixed claw 561 is disposed in the other side of the width direction (−Y side) of the one elastic claw 562.

Another configuration of the fixed claw 561 is similar to another configuration of the fixed claw 61 in the first embodiment. Another configuration of the elastic claw 562 is similar to another configuration of the elastic claws 62 in the first embodiment. Another configuration of the gripping members 550 is similar to another configuration of the gripping members 50 in the first embodiment.

Although embodiments of the present disclosure are described above, the disclosure is not limited to the aforementioned various configurations of the embodiments, and the configurations and methods mentioned below may be adopted.

So long as the claw portions at least include one first claw portion, and at least include one second claw portion, any other claw portions may be included. So long as one claw portion out of the at least one first claw portion included and the at least one second claw portion included is an elastic claw, the other first claw portion or the other second claw portion may be any claw portion. Each of the first claw portion and the second claw portion may include elastic claws. All of the first claw portions and all of the second claw portions may be elastic claws. Shapes of various claw portions may be any shape.

Protrusion heights of the various claw portions with respect to the main body are not limited in any way. A protrusion height of the first claw portion with respect to the main body may be greater than a protrusion height of the second claw portion with respect to the main body. A protrusion height of the elastic claw with respect to the main body may be greater than a protrusion height of the second claw portion with respect to the main body. A relationship between protrusion heights of the various claw portions and the frame body are not limited in any way. So long as the elastic claws are cantilevered by the main body, the elastic claws may be connected to the main body in any manner. Predetermined directions in which the first claw portions and the second claw portions are provided on need not be vertical directions, so long as the directions are orthogonal to the opening direction of the openings.

The heat exchange unit of the present disclosure that is provided with gripping members may be an indoor unit of a refrigeration cycle device. In such a case, an indoor unit for example, may be a floor-mounted indoor unit, or a ceiling-mounted indoor unit or the like. The indoor refrigeration cycle device that includes the heat exchange unit of the present disclosure is not limited to an air conditioning device, so long as the device utilizes a refrigeration cycle where a refrigerant is circulated. The refrigeration cycle device may be a heat pump water heater or the like.

The various configurations and methods described in the above description of the present disclosure may be appropriately combined, as long as the configurations and methods thereof do not mutually contradict one another.

The invention claimed is:

1. A heat exchange unit of a refrigeration cycle device, the heat exchange unit comprising:

a housing having openings, and gripping members attached to the openings, wherein each gripping member of the gripping members has:

a main body having an inner space and that opens to an outside of the housing, and a plurality of claws that protrude from the main body, and that hook to a circumferential edge of the openings from an inside of the housing, the plurality of claws include:

a plurality of first claw portions, and at least one second claw portion that is provided on an opposite side to the plurality of first claw portions in a predetermined direction that intersects the opening direction of an opening, at least one claw portion out of the plurality of first claw portions and the at least one second claw portion is an elastic claw that is cantilevered by the main body, and the elastic claw is elastically deformable in the predetermined direction with respect to the main body, wherein the plurality of first claw portions include:

at least one fixed claw, and at least one elastic claw, and the protrusion height of the at least one fixed claw with respect to the main body is less than the protrusion height of the at least one elastic claw with respect to the main body.

2. The heat exchange unit according to claim 1, wherein a protrusion height of the at least one second claw portion with respect to the main body is greater than a protrusion height of the at least one elastic claw of the plurality of first claw portions with respect to the main body.

3. The heat exchange unit according to claim 1, wherein the main body has a through hole that penetrates a wall portion that configures the main body, and the at least one elastic claw of the plurality of first claw portions is cantilevered by an inner edge of the through hole.

4. The heat exchange unit according to claim 3, wherein the at least one elastic claw of the plurality of first claw portions is connected to an edge, out of inner edge of the through hole, of a side that is far from the opening.

5. The heat exchange unit according to claim 3, wherein the at least one elastic claw of the plurality of first claw portions is provided on an upper side of the main body in a vertical direction.

6. The heat exchange unit according to claim 1, wherein the fixed claw has a first facing surface that faces the circumferential edge of the opening, the at least one elastic claw of the plurality of first claw portions has a second facing surface that faces the circumferential edge of the opening, and the second facing surface is located on a side closer to the circumferential edge of the opening than the first facing surface.

7. The heat exchange unit according to claim 1, wherein the at least one elastic claw of the plurality of first claw portions comprises a plurality of elastic claws.

8. The heat exchange unit according to claim 1, wherein the at least one fixed claw of the plurality of first claw portions comprises a plurality of fixed claws, and the at least one elastic claw of the plurality of first claw portions comprises a single elastic claw.

9. The heat exchange unit according to claim 1, wherein each gripping member of the gripping members has a frame body of a frame shape along an opening edge of the main body, and the frame body is located on the outside of the housing, and sandwiches the circumferential edge of the opening in between with the plurality of claws.

10. The heat exchange unit according to claim 1, wherein the heat exchange unit is an outdoor unit.

* * * * *